US006621475B1

(12) United States Patent
Yamaguchi et al.

(10) Patent No.: US 6,621,475 B1
(45) **Date of Patent: *Sep. 16, 2003**

(54) ELECTRON GENERATING APPARATUS, IMAGE FORMING APPARATUS, METHOD OF MANUFACTURING THE SAME AND METHOD OF ADJUSTING CHARACTERISTICS THEREOF

(75) Inventors: Eiji Yamaguchi, Zama (JP); Hidetoshi Suzuki, Fujisawa (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/803,449

(22) Filed: Feb. 20, 1997

Related U.S. Application Data

(63) Continuation-in-part of application No. 08/774,884, filed on Dec. 27, 1996.

(30) Foreign Application Priority Data

Feb. 23, 1996 (JP) ..... 8-036328
Dec. 12, 1996 (JP) ..... 8-332454
Feb. 14, 1997 (JP) ..... 9-030889

(51) Int. Cl.[7] ..... G09G 3/22
(52) U.S. Cl. ..... 345/74.1; 345/75.2; 313/310
(58) Field of Search ..... 345/74–78, 212; 313/310, 495, 496; 315/169.3, 167

(56) References Cited

U.S. PATENT DOCUMENTS 4,956,578 A 9/1990 Shimizu et al. ..... 315/3
5,066,883 A 11/1991 Yoshioka et al. ..... 313/309
5,155,416 A 10/1992 Suzuki et al. ..... 315/366
5,209,687 A * 5/1993 Konishi ..... 445/6

(List continued on next page.)

FOREIGN PATENT DOCUMENTS

EP 0 651 418 A1 5/1995
EP 0 785 564 A1 7/1997
JP 64-31332 2/1989

(List continued on next page.)

OTHER PUBLICATIONS

Dittmer, G., "Electrical Conduction And Electron Emission Of Discontinuous Thin Films," *Thin Solid Films*, vol. 9 (1972), pp. 371–328.

(List continued on next page.)

*Primary Examiner*—Steven Saras
*Assistant Examiner*—Amr Awad
(74) *Attorney, Agent, or Firm*—Fitzpatrick, Cella, Harper & Scinto

(57) ABSTRACT

It is an object of this invention to provide an electron generating apparatus which eliminates, with a simple process, variations in electron-emitting characteristics of electron sources caused by various factors, a method of adjusting the characteristics of the electron generating apparatus, a method of manufacturing the electron generating apparatus, and an image forming apparatus using the electron generating apparatus. Characteristic measuring voltages are applied from pulse generators (6, 7) to each surface-conduction emission device of a display panel (1), so that the electron-emitting characteristics are measured by a current detector (12). A pulse peak value setting circuit (8) is controlled to output a voltage signal having a peak value determined in the above manner, and characteristic shift voltages are applied from the pulse generators (6, 7) to the surface-conduction emission device. With this process, the electron-emitting characteristics of the surface-conduction emission devices are equalized. The characteristic shift voltage is higher than the characteristic measuring voltage, and the characteristic measuring voltage is higher than a driving voltage.

32 Claims, 25 Drawing Sheets

U.S. PATENT DOCUMENTS

| | | | | | |
|---|---|---|---|---|---|
| 5,587,623 | A | * | 12/1996 | Jones | 313/497 |
| 5,594,463 | A | * | 1/1997 | Sakamoto | 345/76 |
| 5,605,483 | A | | 2/1997 | Takeda et al. | 445/2 |
| 5,682,085 | A | * | 10/1997 | Suzuki et al. | 315/169.1 |
| 5,850,120 | A | * | 12/1998 | Okamoto | 313/336 |
| 5,872,551 | A | * | 2/1999 | Bancal et al. | 345/74 |
| 5,909,202 | A | * | 6/1999 | Cathey | 345/74 |
| 5,986,624 | A | * | 11/1999 | Ando et al. | 345/74 |

FOREIGN PATENT DOCUMENTS

| | | |
|---|---|---|
| JP | 2-257551 | 10/1990 |
| JP | 4-28137 | 1/1992 |
| JP | 4-249827 | 9/1992 |
| JP | 7-094103 | 4/1995 |
| JP | 8-96700 | 4/1996 |

OTHER PUBLICATIONS

Elinson, M.L., et al., "The Emission of Hot Electrons and the Field Emission of Electrons from Tin Oxide" *Radio Engineering and Electronic Physics*, (1965), pp. 1290–1296.

Mead, C.A., "Operation of Tunnel–Emission Devices", *Journ. of Appl. Phy.*, vol. 32, No. 4, (1961) pp. 646–652.

Spindt, C.A., et al., "Physical Properties of Thin–film Field Emission Cathodes with Molybdenum Cones", *Journ. of Appl. Phy.*, vol. 47, no 12, (1976), pp. 5248–5263.

European Search Report dated Dec. 22, 1998.

Advances in Electronics and Electron Physics, Academic Press Inc., New York, NY, vol. III, 1956, "Field Emission", W.P. Dyke, et al.

Journal of Applied Physics, vol. 47, No. 12, Dec. 1976, "Physical properties of thin–film field emission cathodes with molybdenum cones", C.A. Spindt, et al.

Journal of Applied Physics, vol. 32, No. 4, Apr. 1961, pp. 646–652, "Operation of Tunnel–Emission Devices", C.A. Mead.

International Electron Devices Meeting, Washington, D.C., 1975, pp. 519–521, "Strong Electron Emission From Patterned Tin–Indium Oxide Thin Films", M. Hartwell, et al.

Thin Solid Films, Sep. 1972, pp. 317–328, Electrical Conduction and Electron Emission Of Discontinuous Thin Films, G. Dittmer.

Radio Engineering and Electronic Physics, Jul. 1965, pp. 1290–1296, "The Emission Of Hot Electrons and the Field Emission Of Electrons From Tin Oxide", M. I. Elinson, et al.

Journal of the Vacuum Society of Japan, vol. 26, No. 1, pp. 22–29, "Electroforming and Electron Emission of Carbon Thin Films", H. Araki, et al.

* cited by examiner

ELECTRON GENERATING APPARATUS, IMAGE FORMING APPARATUS, METHOD OF MANUFACTURING THE SAME AND METHOD OF ADJUSTING CHARACTERISTICS THEREOF

This is a continuation-in-part application of U.S. patent application Ser. No. 08/774,884 filed on Dec. 27, 1996 entitled "ELECTRON GENERATING APPARATUS, IMAGE FORMING APPARATUS, METHOD OF MANUFACTURING THE SAME AND METHOD OF ADJUSTING CHARACTERISTICS THEREOF".

BACKGROUND OF THE INVENTION

1. Field of the Invention

The present invention relates to an electron generating apparatus constituted by arranging a plurality of surface-conduction emission devices on a substrate, a method of adjusting the characteristics of the electron generating apparatus, a method of manufacturing the electron generating apparatus, and an image forming apparatus using the electron generating apparatus.

2. Related Background Art

Conventionally, two types of devices, namely thermionic and cold cathode devices, are known as electron-emitting devices. Examples of cold cathode devices are surface-conduction emission devices, field emission type emission devices (to be referred to as FE type devices hereinafter), and metal/insulator/metal type emission devices (to be referred to as MIM type devices hereinafter).

Known examples of the FE type devices are described in W. P. Dyke and W. W. Dolan, "Field Emission", Advance in Electron Physics, 8,89 (1956) and C. A. Spindt, "Physical properties of thin-film field emission cathodes with molybdenum cones", J. Appl. Phys., 47,5248 (1976).

A known example of the MIM type devices is described in C. A. Mead, "Operation of Tunnel-emission Devices", J. Appl. Phys., 32,646 (1961).

A known example of the surface-conduction emission devices is described in, e.g., M. I. Elinson, Radio. Eng. Electron Phys., 10 (1965) and other examples to be described later.

The surface-conduction emission device utilizes the phenomenon that electron emission is caused in a small-area thin film, formed on a substrate, by passing a current parallel to the film surface. The surface-conduction emission device includes devices using an Au thin film (G. Dittmer, "Thin Solid Films", 9,317 (1972)), an $In_2O_3/SnO_2$ thin film (M. Hartwell and C. G. Fonstad, "IEEE Trans. ED Conf.", 519 (1975)), and a carbon thin film (Hisashi Araki, et al., "Vacuum", Vol. 26, No. 1, p. 22 (1983)), and the like, in addition to an $SnO_2$ thin film according to Elinson mentioned above.

FIG. 27 is a plan view of the surface-conduction emitting device according to M. Hartwell et al. as a typical example of the structures of these surface-conduction emission devices. Referring to FIG. 27, reference numeral 3001 denotes a substrate; and 3004, a conductive thin film made of a metal oxide formed by sputtering. This conductive thin film 3004 has an H-shaped pattern, as shown in FIG. 27. An electron-emitting portion 3005 is formed by performing an electrification process (referred to as an energization forming process to be described later) with respect to the conductive thin film 3004. Referring to FIG. 27, a spacing L is set to 0.5 to 1 [mm], and a width W is set to 0.1 [mm]. The electron-emitting portion 3005 is shown in a rectangular shape at the center of the conductive thin film 3004 for the sake of illustrative convenience, however, this does not exactly show the actual position and shape of the electron-emitting portion.

In the above surface-conduction emission device by M. Hartwell et al., typically the electron-emitting portion 3005 is formed by performing the electrification process called the energization forming process for the conductive thin film 3004 before electron emission. According to the energization forming process, electrification is performed by applying a constant DC voltage which increases at a very slow rate of, e.g., 1 V/min, to both ends of the conductive thin film 3004, so as to partially destroy or deform the conductive thin film 3004 or change the properties of the conductive thin film 3004, thereby forming the electron-emitting portion 3005 with an electrically high resistance. Note that the destroyed or deformed part of the conductive thin film 3004 or part where the properties are changed has a fissure. Upon application of an appropriate voltage to the conductive thin film 3004 after the energization forming process, electron emission is performed near the fissure.

The above surface-conduction emission devices are advantageous because, of cold cathode devices, they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction emission devices to, e.g., image forming apparatuses such as an image display apparatus and an image recording apparatus, charged beam sources and the like have been studied.

As an application to image display apparatuses, in particular, as disclosed in U.S. Pat. No. 5,066,883 and Japanese Patent Laid-Open Nos. 2-257551 and 4-28137 filed by the present applicant, an image display apparatus using the combination of a surface-conduction emission device and a phosphor which emits light upon irradiation of an electron beam has been studied. This type of image display apparatus is expected to have more excellent characteristics than other conventional image display apparatuses. For example, in comparison with recent popular liquid crystal display apparatuses, the above display apparatus is superior in that is does not require a backlight since it is of a light emissive type and that it has a wide view angle.

The present inventors have examined cold cathode devices according to various materials, manufacturing methods, and structures, in addition to the above conventional devices. The present inventors have also studied a multi-electron-beam source in which a lot of cold cathode devices are arranged, and an image display apparatus to which this multi-electron-beam source is applied.

The present inventors have also examined a multi-electron-beam source according to an electric wiring method shown in FIG. 28. More specifically, this multi-electron-beam source is constituted by two-dimensionally arranging a large number of cold cathode devices and wiring these devices in a matrix, as shown in FIG. 28.

Referring to FIG. 28, reference numeral 4001 denotes a cold cathode device; 4002, a row wiring layer; and 4003, a column wiring layer. The row wiring layers 4002 and the column wiring layers 4003 actually have limited electrical resistances which are represented as wiring resistances 4004 and 4005 in FIG. 28. The wiring shown in FIG. 28 is referred to as simple matrix wiring. For the illustrative convenience, the multi-electron-beam source constituted by a 6×6 matrix is shown in FIG. 28. However, the scale of the matrix is not limited to this arrangement, as a matter of course. In a multi-electron-beam source for an image display apparatus, a number of devices sufficient to perform desired image display are arranged and wired.

In the multi-electron-beam source in which the surface-conduction emission devices are wired in a simple matrix, appropriate electrical signals are supplied to the row wiring layers 4002 and the column wiring layers 4003 to output desired electron beams. When the surface-conduction emission devices of an arbitrary row of the matrix are to be driven, a selection voltage Vs is applied to the row wiring layer 4002 of the selected row. Simultaneously, a non-selection voltage Vns is applied to the row wiring layers 4002 of unselected rows. In synchronism with this operation, a driving voltage Ve for outputting electron beams is applied to the column wiring layers 4003. According to this method, a voltage (Ve−Vs) is applied to the surface-conduction emission devices of the selected row, and a voltage (Ve−Vns) is applied to the surface-conduction emission devices of the unselected rows, assuming that a voltage drop caused by the wiring resistances 4004 and 4005 is negligible. When the voltages Ve, Vs, and Vns are set to appropriate levels, electron beams with a desired intensity are output from only the surface-conduction emission devices of the selected row. When different driving voltages Ve are applied to the respective column wiring layers 4003, electron beams with different intensities are output from the respective devices of the selected row. Since the response of the surface-conduction emission device is high, the period of time over which electron beams are output can also be changed in accordance with the period of time for applying the driving voltage Ve.

The multi-electron-beam source having surface-conduction emission devices arranged in a simple matrix can be used in a variety of applications. For example, the multi-electron-beam source can be suitably used as an electron source for an image display apparatus by appropriately supplying an electrical signal according to image information.

As a result of extensive studies for improving the characteristics of the surface-conduction emission device, the present inventors found that an activation process in the manufacturing process was effective.

As described above, when the electron-emitting portion of the surface-conduction emission device is to be formed, a process (energization forming process) of flowing a current to the conductive thin film to locally destroy, deform, or deteriorate the thin film and form a fissure is performed. Thereafter, when the activation process is performed, the electron-emitting characteristic can be largely improved.

More specifically, the activation process is a process of performing electrification of the electron-emitting portion formed by the energization forming process, under appropriate conditions, to deposit carbon or a carbon compound around the electron-emitting portion. For example, a voltage pulse is periodically applied in a vacuum atmosphere in which an organic substance at an appropriate partial pressure exists, and the total pressure is $10^{-4}$ to $10^{-5}$ [Torr]. With this process, any of monocrystalline graphite, polycrystalline graphite, amorphous carbon, and a mixture thereof is deposited near the electron-emitting portion to a thickness of 500 [Å] or less. These conditions are only examples and must be appropriately changed in accordance with the material and shape of the surface-conduction emission device.

With this process, comparing the electron-emitting portion with that before the activation process, the emission current at the same applied voltage can be increased typically about 100 times or more. After the activation process is completed, the partial pressure of an organic substance in the vacuum atmosphere is preferably reduced.

Therefore, in manufacturing a multi-electron-beam source in which a lot of surface-conduction emission devices are wired in a simple matrix as well, the activation process is preferably performed for each device.

In the multi-electron-beam source manufactured in the above manner, the emission characteristics of the electron sources vary due to variations during the process. If such devices are used to form a display apparatus, the variation in characteristics appears as a luminance variation. There are various factors affecting the electron-emitting characteristics of the respective electron sources of the multi-electron-beam source: variations in components of a material used for the electron-emitting portion, dimensional errors of the members of devices, nonuniform electrification conditions in the energization forming process, and nonuniform electrification conditions or atmospheric gas in the activation process. However, to eliminate all these factors, the most advanced manufacturing equipment and strict process management are required, and this increases the manufacturing cost to an impractical level.

SUMMARY OF THE INVENTION

The present invention has been made in consideration of the above conventional problem, and has as its object to provide an electron generating apparatus which eliminates variations in electron-emitting characteristics of a multi-electron-beam source caused by the above-described various factors, a method of adjusting the characteristics of the electron generating apparatus, a method of manufacturing the electron generating apparatus, and an image forming apparatus using the electron generating apparatus.

It is another object of the present invention to provide an electron generating apparatus which substantially equalizes the characteristics of a multi-electron-beam source by using a property unique to a surface-conduction emission device, a method of adjusting the characteristics of the electron generating apparatus, a method of manufacturing the electron generating apparatus, and an image forming apparatus using the electron generating apparatus.

In order to achieve the above objects, the present invention provides a method of adjusting characteristics of an electron generating apparatus having a multi-electron-beam source in which a plurality of surface-conduction emission devices are arranged on a substrate, and driving means for outputting a driving voltage to the multi-electron-beam source, comprising the steps of applying a characteristic measuring voltage to measure the characteristics of the plurality of surface-conduction emission devices, obtaining a reference value of the characteristics of the plurality of surface-conduction emission devices on the basis of the measured electron-emitting characteristics, and applying a characteristic shift voltage to a corresponding one of the plurality of surface-conduction emission devices such that the electron-emitting characteristics of the plurality of surface-conduction emission devices become values according to the reference value, wherein the characteristic shift voltage is higher than characteristic measuring voltage, and the characteristic measuring voltage is higher than the driving voltage.

Preferably, the characteristic shift voltage is applied in an atmosphere in which a partial pressure of an organic gas is not more than $10^{-8}$ Torr.

The method can further comprise the steps of measuring the characteristics of the plurality of surface-conduction emission devices again after application of the characteristic shift voltage, and applying the characteristic shift voltage to the corresponding surface-conduction emission device again on the basis of a remeasurement result.

In the measuring step, an emission current emitted from the surface-conduction emission device can be measured every time the surface-conduction emission device is driven.

In the measuring step, a device current flowing in the surface-conduction emission device can be measured every time the surface-conduction emission device is driven.

In the measuring step, a light emission luminance of electron emission from the surface-conduction emission device can be measured every time the surface-conduction emission device is driven, and the measured luminance can be converted into a value corresponding to the emission current or the device current.

The present invention also incorporates a method of manufacturing an electron generating apparatus. According to the present invention, there is provided a method of manufacturing an electron generating apparatus having a multi-electron-beam source in which a plurality of surface-conduction emission devices are arranged in a matrix on a substrate, and driving means for outputting a driving voltage to the multi-electron-beam source, comprising the steps of forming electrodes and conductive films for the plurality of surface-conduction emission devices on the substrate, forming electron-emitting portions for the plurality of surface-conduction emission devices by performing electrification to the conductive films through the electrodes, activating the electron-emitting portions, applying a characteristic measuring voltage to measure characteristics of the plurality of surface-conduction emission devices, obtaining a reference value of the characteristics of the plurality of surface-conduction emission devices on the basis of the measured electron-emitting characteristics, and applying a characteristic shift voltage to a corresponding one of the plurality of surface-conduction emission devices such that the electron-emitting characteristics of the plurality of surface-conduction emission devices become values according to the reference value, wherein the characteristic shift voltage is higher the characteristic measuring voltage, and the characteristic measuring voltage is higher than the driving voltage.

Preferably, the characteristic shift voltage is applied in an atmosphere in which a partial pressure of an organic gas is not more than $10^{-8}$ Torr.

The method can further comprise the steps of measuring the characteristics of the plurality of surface-conduction emission devices again after application of the characteristic shift voltage, and applying the characteristic shift voltage to the corresponding surface-conduction emission device again on the basis of a remeasurement result.

In the measuring step, an emission current emitted from the surface-conduction emission device can be measured every time the surface-conduction emission device is driven.

In the measuring step, a device current flowing in the surface-conduction emission device can be measured every time the surface-conduction emission device is driven.

In the measuring step, a light emission luminance of the phosphor member can be measured every time the surface-conduction emission device is driven, and the measured luminance can be converted into a value corresponding to the emission current or the device current.

The present invention also incorporates an electron generating apparatus and an image display apparatus themselves. The present invention provides an electron generating apparatus comprising a multi-electron-beam source in which a plurality of surface-conduction emission devices are arranged on a substrate, and driving means for driving the multi-electron-beam source on the basis of an image signal, wherein the electron generating apparatus is manufactured by the above-described method.

The present invention provides an image forming apparatus comprising the above-described electron generating apparatus, and a phosphor which emits light upon irradiation of an electron beam from the multi-electron-beam source.

In the present invention, before or after the electron-emitting characteristics of each surface-conduction emission device are measured, and before the characteristic shift voltage for changing the characteristics of the device is applied, the organic gas must be removed from the atmosphere around the device.

To prevent the characteristics of the device from being changed by the display driving pulse, the values of voltages applied to each surface-conduction emission device preferably satisfy the relationship: (peak value of display driving pulse)<(applied voltage value in measurement)<(peak value of memory waveform signal). The display driving pulse can also be referred to as a driving voltage. The applied voltage value in measurement can also be referred to as a characteristic measuring voltage. The memory waveform signal can also be referred to as a characteristic shift voltage.

The electron generating apparatus of the present invention can be used for EB (Electron Beam) drawing in the semiconductor manufacturing process.

In addition, the method of adjusting the characteristic of the electron generating apparatus of the present invention can also be used when the electron-emitting characteristics of the surface-conduction emission device are changed with the elapse of time after completion of the electron generating apparatus.

According to the present invention, variations in electron-emitting characteristics of the electron-emitting devices caused by various factors can be eliminated with a simple process.

According to the present invention, the characteristics of the electron-emitting devices can be substantially equalized using a property unique to the surface-conduction emission device.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

A means for solving the above problem will be described below in detail. In the present invention, a function of storing the electron-emitting characteristics (to be referred to as an electron-emitting characteristic memory function hereinafter), which is imparted to a surface-conduction emission device, is used to store a predetermined electron-emitting characteristic in units of surface-conduction emission devices. With this arrangement, the electron-emitting characteristics of the respective surface-conduction emission devices are equalized.

An electron-emitting characteristic memory function exhibited by a surface-conduction emission device of the present invention will be described below.

The present inventors drove a surface-conduction emission device having undergone energization forming process and activation process in an atmosphere where the partial pressure of an organic gas was reduced, and measured its electrical characteristics.

Figure 1A:
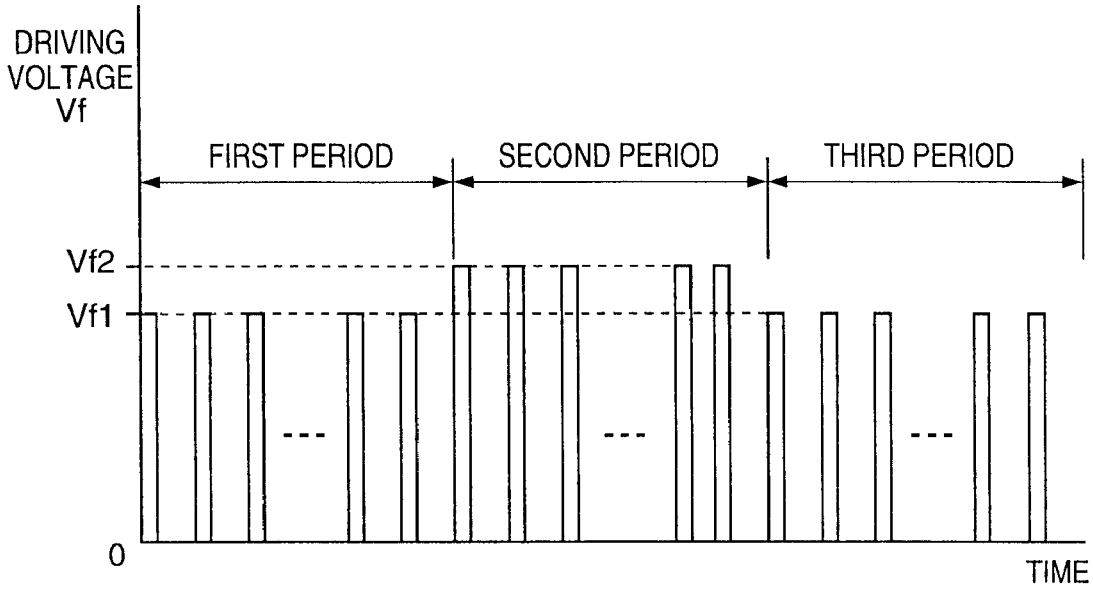
FIGS. 1A and 1B are charts showing an example of a memory waveform signal for a surface-conduction emission device of the present invention.
Figure 1B:
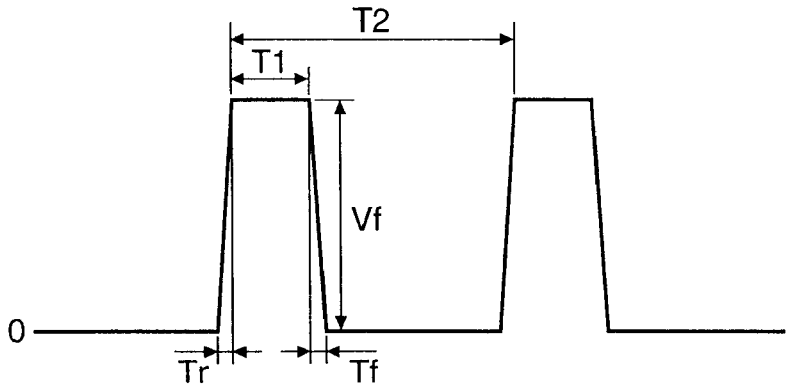

FIGS. 1A and 1B are charts showing the voltage waveform of a driving signal applied to the surface-conduction emission device of the present invention. The abscissa represents the time axis; and the ordinate, the voltage (to be referred to as a device voltage Vf hereinafter) applied to the surface-conduction emission device.

As shown in FIG. 1A, consecutive rectangular voltage pulses were used as a driving signal, and the application period of the voltage pulses was divided into three periods, namely first to third periods. In each period, 100 identical pulses were applied. FIG. 1B is an enlarged view of the waveform of such a voltage pulse shown in FIG. 1A.

Measurement conditions were: pulse width T1=66.8 [$\mu$sec] and pulse period T2=16.7 [msec] in each period. These conditions were determined with reference to the standard driving conditions set when a surface-conduction emission device was applied to a general TV receiver. However, the memory function can be measured under other conditions. Note that measurement was performed while the impedance of a wiring path from a driving signal source to each surface-conduction emission device was sufficiently reduced such that both a rise time Tr and a fall time Tf of a voltage pulse effectively applied to the surface-conduction emission device became equal to or lower than 100 [ns].

The device voltage Vf was Vf=Vf1 in the first and third periods, and Vf=Vf2 in the second period. Both the device voltages Vf1 and Vf2 were set to be higher than the electron emission threshold voltage of each surface-conduction emission device and to satisfy Vf1<Vf2. Since the electron emission threshold voltage varies depending on the shape and material of a surface-conduction emission device, these voltages are appropriately set in accordance with a surface-conduction emission device to be measured. With regard to an atmosphere around the surface-conduction emission device in a measurement operation, the total pressure was $1\times10^{-6}$ [Torr], and the partial pressure of an organic gas was $1\times10^{-9}$ [Torr].

Figure 2A:
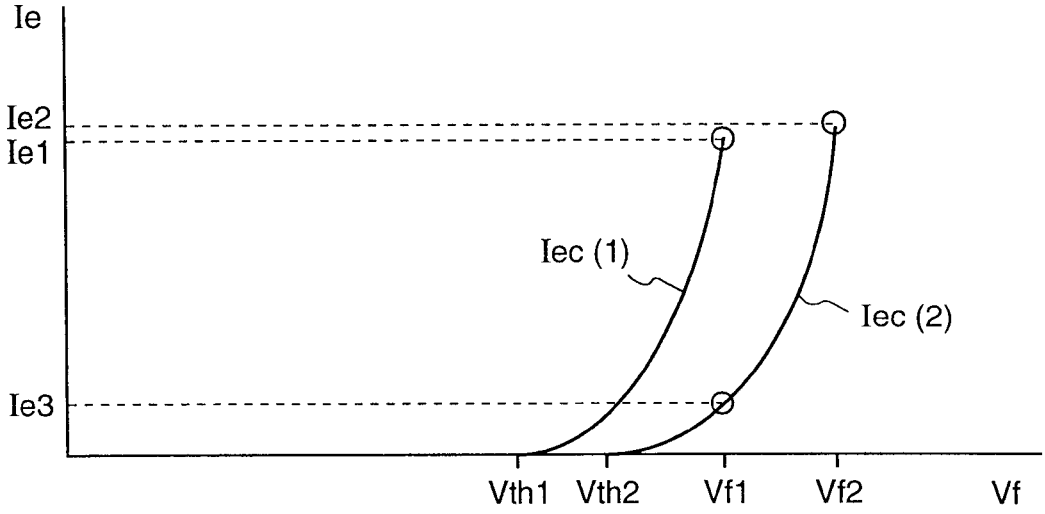
FIGS. 2A and 2B are graphs for explaining the difference between the characteristics of emission currents with respect to the driving voltage of the surface-conduction emission device.
Figure 2B:
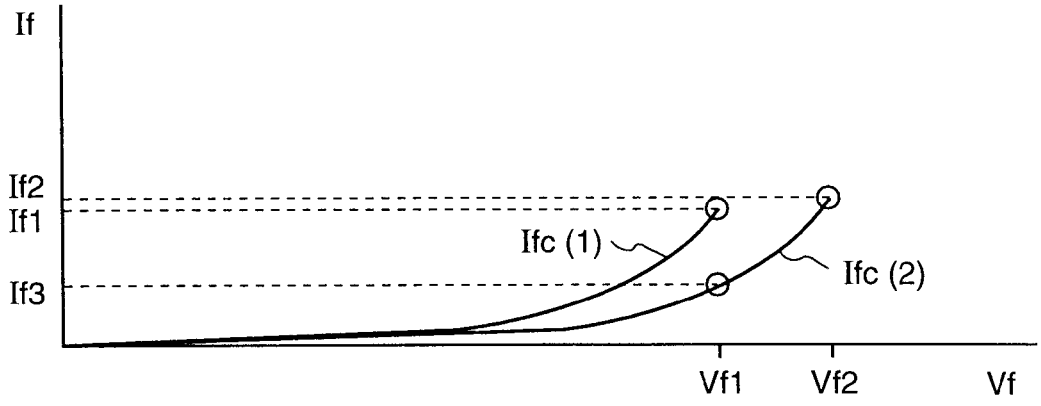

FIGS. 2A and 2B are graphs showing the electrical characteristics of the surface-conduction emission device upon application of the driving signal shown in FIGS. 1A and 1B. Referring to FIG. 2A, the abscissa represents the device voltage Vf; and the ordinate, the measurement value of a current (to be referred to as an emission current Ie hereinafter) emitted from the surface-conduction emission device. Referring to FIG. 2B, the abscissa represents the device voltage Vf; and the ordinate, the measurement value of a current (to be referred to as a device current If hereinafter) flowing in the surface-conduction emission device.

The (device voltage Vf) vs. (emission current Ie) characteristic shown in FIG. 2A will be described first.

In the first period shown in FIG. 1A, the surface-conduction emission device outputs an emission current according to a characteristic curve Iec(1) in response to a driving pulse. In the rise time Tr of the driving pulse, when the applied voltage Vf exceeds Vth1, the emission current Ie abruptly increases according to the characteristic curve Iec(1). In the period of Vf=Vf1, i.e., the interval of the pulse width T1, the emission current Ie is kept at Ie1. In the fall time Tf of the driving pulse, the emission current Ie abruptly decreases according to the characteristic curve Iec(1).

In the second period, when application of a pulse given by Vf=vf2 is started, the characteristic curve Iec(1) changes to a characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf2, i.e., the interval T1, the emission current Ie is kept at Ie2. In the fall time Tf of the driving pulse, the emission current Ie abruptly decreases according to the characteristic curve Iec(2).

In the third period, although the pulse given by Vf=Vf1 is applied again, the emission current Ie changes according to the characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf1, i.e., the interval T1, the emission current Ie is kept at Ie3. In the fall time Tf of the driving pulse, the emission current Ie abruptly decreases according to the characteristic curve Iec(2).

As described above, in the third period, since the characteristic curve Iec(2) in the second period is stored, the emission current Ie decreases from Ie1 to Ie3 and becomes smaller than that in the first period.

With regard to the (device voltage Vf) vs. (device current If) characteristic as well, as shown in FIG. 2B, the device operates according to a characteristic curve Ifc(1) in the first period. In the second period, however, the device operates according to a characteristic curve Ifc(2). In the third period, the device operates according to the characteristic curve Ifc(2) stored in the second period.

For the sake of descriptive convenience, only the three periods, i.e., the first to third periods, are set. As is apparent, however, the setting is not limited to this condition. In applying a pulse voltage to a surface-conduction emission device having a memory function, when a pulse having a voltage value larger than that of a previously applied pulse is applied, the characteristic curve shifts, and the resultant characteristic is stored. Subsequently, the characteristic curve (electron-emitting characteristic) is kept stored unless a pulse having a larger voltage value is applied. Such a memory function has not been observed in other electron-emitting devices including FE type electron-emitting devices. This characteristic is therefore unique to a surface-conduction emission device.

An environment necessary for realizing the electron-emitting characteristic memory function will be described next. To satisfactorily realize the memory function, the partial pressure of an organic gas in the vacuum atmosphere around the surface-conduction emission device must be reduced, thereby preventing further deposition of carbon or a carbon compound at the electron-emitting portion or its peripheral portion even when a voltage is applied to the surface-conduction emission device, and this state must be maintained. Preferably, the partial pressure of the organic gas in the atmosphere is reduced to $10^{-8}$ [Torr] or less, and this state is maintained. If possible, the partial pressure is preferably maintained at $10^{-10}$ [Torr] or less. Note that the partial pressure of the organic gas is obtained by integrating the partial pressures of organic molecules mainly consisting of carbon and hydrogen and having a mass number of 13 to 200, which is quantitatively measured using a mass spectrograph.

A typical method of reducing the partial pressure of the organic gas around the surface-conduction emission device is as follows. The vacuum vessel incorporating the substrate on which the surface-conduction emission device is formed is heated. While removing the organic gas molecules from the surface of each member in the vessel, vacuum evacuation is performed using a vacuum pump such as a sorption pump or an ion pump using no oil. After the partial pressure of the organic gas is reduced in this manner, this state can be maintained by continuously performing evacuation using the vacuum pump with no oil. However, this method using the vacuum pump for continuous evacuation has disadvantages in volume, power consumption, weight, and cost depending on the application purpose. When the surface-conduction emission device is to be applied to an image display apparatus, the organic gas molecules are sufficiently removed to reduce the partial pressure of the organic gas, and thereafter, a getter film is formed in the vacuum vessel, and at the same time, the exhaust pipe is sealed, thereby maintaining the state.

In many cases, the origin of the organic gas remaining in the vacuum atmosphere is the vapor of an oil used in the vacuum exhaust unit such as a rotary pump or an oil diffusion pump, or the residue of an organic solvent used in the manufacturing processes of the surface-conduction emission device. Examples of the organic gas are aliphatic hydrocarbons such as alkane, alkene, and alkyne, aromatic hydrocarbons, alcohols, aldehydes, ketones, amines, phenols, organic acids such as carboxylic acid and sulfonic acid, or derivatives of the above-described organic substances: more specifically, butadiene, n-hexane, 1-hexene, benzene, toluene, O-xylene, benzonitrile, chloroethylene, trichloroethylene, methanol, ethanol, isopropanol, formaldehyde, acetaldehyde, acetone, methyl ethyl ketone, diethyl ketone, methylamine, ethylamine, acetic acid, and propionic acid.

The preferred embodiments of the present invention will be described below in detail with reference to the accompanying drawings.

FIRST EMBODIMENT

In the first embodiment, an electron emission characteristics of each surface conduction emission device is measured prior to actually usage of the surface conduction emission devices for displaying an image. If the electron emission characteristics of each device has variance, then the characteristics must be corrected to become uniform. The correction method has several steps, and a voltage to be added to each device in each step is set as follows. Particularly, $VE_{measure}$, a driving voltage for measuring the emission current characteristics of each device in a measuring step, $V_{shift}$, a characteristics shift voltage for adjusting the characteristics of each device to become uniform in an adjusting step, $V_{drive}$, a maximum voltage for driving the devices to display an image. Those voltages have a relation as shown below.

$$V_{drive}<VE_{measure}<V_{shift}$$

As shown above, since $VE_{measure}$ is higher than $V_{drive}$, a higher voltage is added to each surface conduction emission device in advance, than a driving voltage of displaying an image. Therefore, the characteristics of each device is kept from being changed by being added a higher voltage in an actual usage. Further, since $V_{shift}$ is set to be more higher than $VE_{measure}$, the shift characteristics voltage $V_{shift}$ is a maximum voltage to be added to each surface conduction emission device. Accordingly, the electron emission characteristics of each device can be corrected to a desired value by adding the $V_{shift}$. Furthermore, since $V_{shift}$, is set to be a higher than $V_{drive}$, the characteristics of each device does not change in the actual usage after the characteristics of each device has been adjusted to be uniform.

Figure 3:
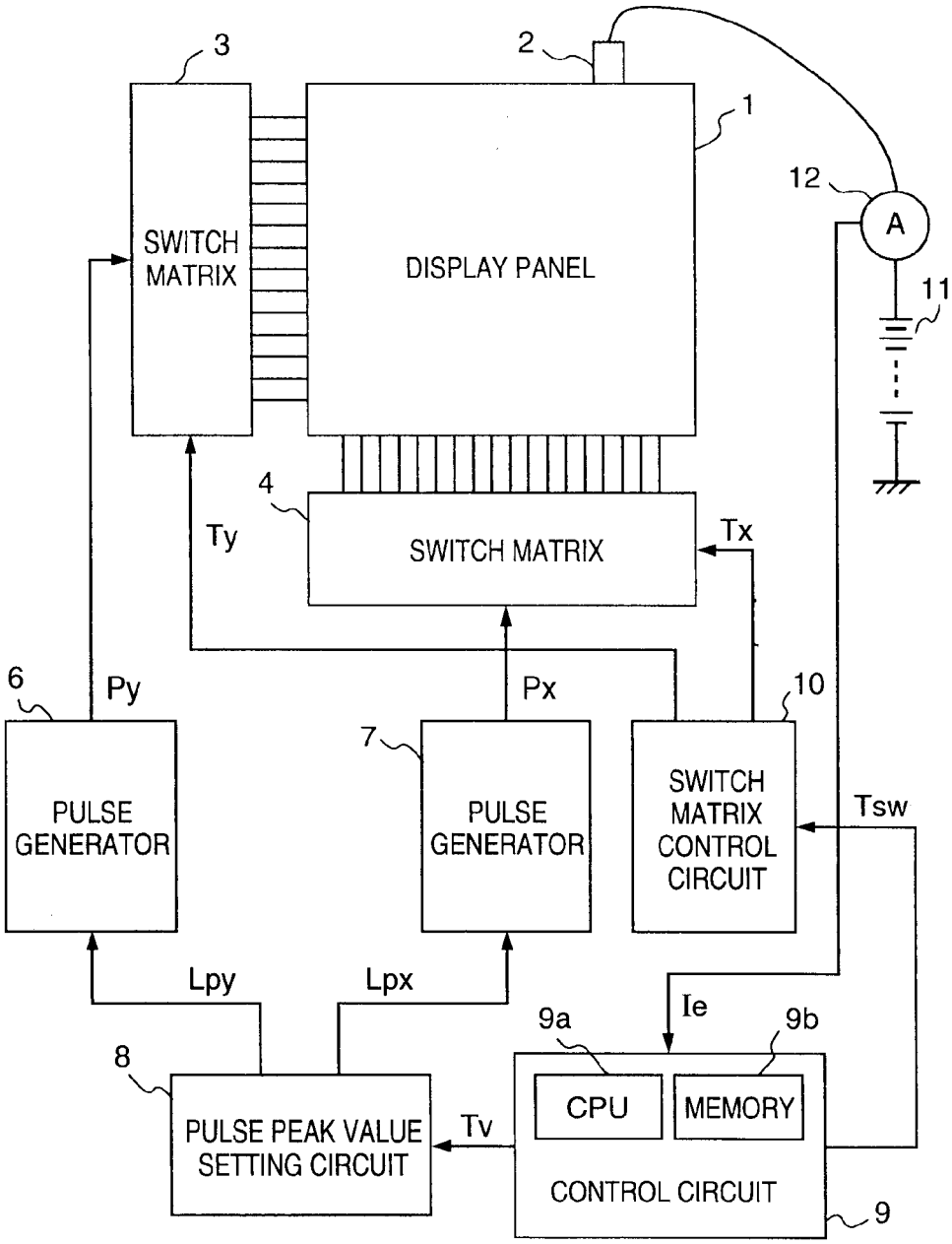
FIG. 3 is a block diagram showing the arrangement of an apparatus for applying the memory waveform signal to a multi-electron-beam source according to the first embodiment of the present invention.

FIG. 3 is a block diagram showing the arrangement of a driving circuit which applies a memory waveform signal to each surface-conduction emission device of a display panel 1 to change the electron-emitting characteristics of each surface-conduction emission device of an electron source substrate.

Referring to FIG. 3, in the display panel 3, a substrate having a plurality of surface-conduction emission devices arranged in a matrix, a face plate arranged above the substrate and having phosphors which emit light upon electron irradiation from the surface-conduction emission devices, and the like are disposed in a vacuum vessel. A terminal 2 is provided to apply a high voltage from a high-voltage source 11 to the phosphors of the display panel 1. Switch matrixes 3 and 4 respectively select a row wiring layer and a column wiring layer to select an electron-emitting device to which a pulse voltage is to be applied. Pulse generators 6 and 7 respectively generate pulse waveform signals Px and Py for the memory function described above. A pulse peak value setting circuit 8 outputs pulse setting signals Lpx and Lpy to determine the peak values of the pulse signals output from the pulse generators 6 and 7. A control circuit 9 detects the difference between the set value and an emission current value Ie detected by a current detector 12 and outputs data Tv for setting the peak value to the pulse peak value setting circuit 8. A CPU 9*a* controls the operation of the control circuit 9. A memory 9*b* stores the control program (flow charts of FIGS. 7 and 8) of the CPU 9*a* and various data. A switch matrix control circuit 10 outputs switch change-over signals Tx and Ty to control switch selection of the switch matrixes 3 and 4, thereby selecting an electron-emitting device to which the pulse voltage for the memory function is to be applied.

The operation of this driving circuit will be described next. The operation of this circuit comprises a stage of measuring the electron emission current of each surface-conduction emission device of the display panel 1, and a stage of applying a pulse waveform signal for the memory function in correspondence with the detected emission current.

The method of measuring the emission current Ie will be described first. In accordance with a switch matrix control signal Tsw from the control circuit 9, the switch matrix control circuit 10 is selectively connected such that the switch matrixes 3 and 4 can select predetermined row and column wiring layers, respectively, to drive a desired surface-conduction emission device.

The control circuit 9 outputs the peak value data Tv for electron-emitting characteristic measurement to the pulse peak value setting circuit 8. The peak value data Lpx and Lpy are output from the pulse peak value setting circuit 8 to the pulse generators 6 and 7, respectively. On the basis of the peak value data Lpx and Lpy, the pulse generators 6 and 7 respectively output the driving pulses Px and Py which are applied to the device selected by the switch matrixes 3 and 4. The driving pulses Px and Py have opposite polarities and an amplitude ½ a voltage (peak value) Vf1 applied to the surface-conduction emission device for measurement. At the same time, a predetermined voltage is applied from the high-voltage source 11 to the phosphor of the display panel 1. The emission current Ie flowing when the surface-conduction emission device is being driven by the driving pulses Px and Py is measured by the current detector 12.

Figure 7:
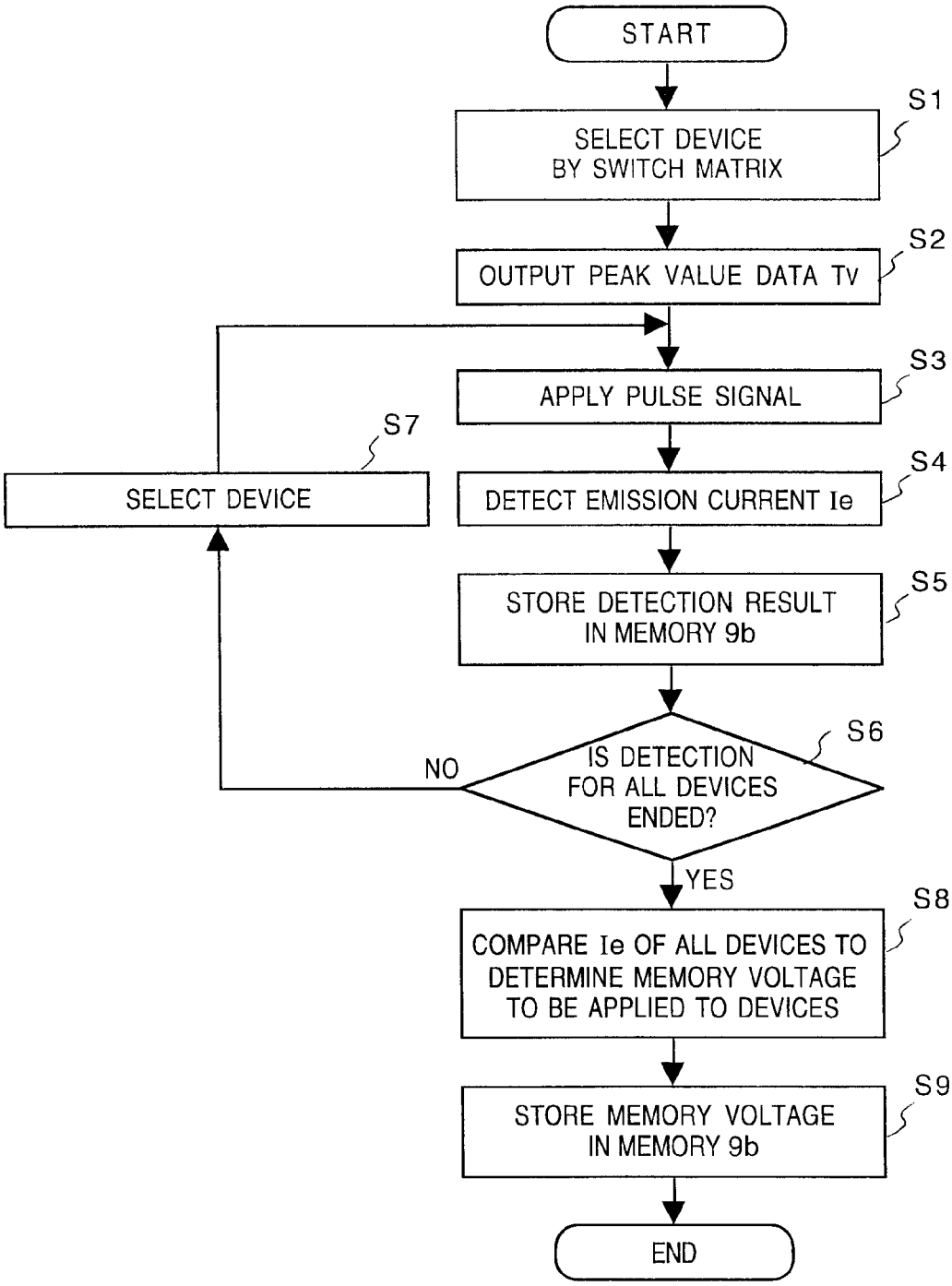
FIG. 7 is a flow chart showing a process of measuring the electron-emitting characteristics of each surface-conduction emission device of the electron source of the first embodiment.

FIG. 7 is a flow chart showing the characteristic measurement process by the control circuit 9.

In step S1, the switch matrix control signal Tsw is output, and the switch matrixes 3 and 4 are switched by the switch matrix control circuit 10, thereby selecting a surface-conduction emission device of the display panel 1. In step S2, the peak value data Tv of a pulse signal to be applied to the selected device is output to the pulse peak value setting circuit 8. The peak value for measurement is higher than a driving voltage Vf for displaying an image. In step S3, the pulse generators 6 and 7 supply the pulse signals for measuring the characteristics of the electron-emitting device is applied to the surface-conduction emission device selected in step S1, through the switch matrixes 3 and 4. The electron emission current Ie at this time is input in step S4 and stored in the memory 9*b* in step S5.

In step S6, it is checked whether measurement has been performed for all the surface-conduction emission devices of the display panel 1. If NO in step S6, the flow advances to step S7. The switch matrix control signal Tsw is output to select the next surface-conduction emission device, and the flow returns to step S3.

If YES in step S6, the flow advances to step S8. The emission currents Ie of all the surface-conduction emission devices of the display panel 1 are compared. As will be described later with reference to, e.g., FIGS. 4 and 5, a memory application voltage value to be applied to each device is determined. The determined voltage value is stored in the memory 9*b*.

An example of the emission current measured in the above manner will be described with reference to FIG. 4.

Figure 4:
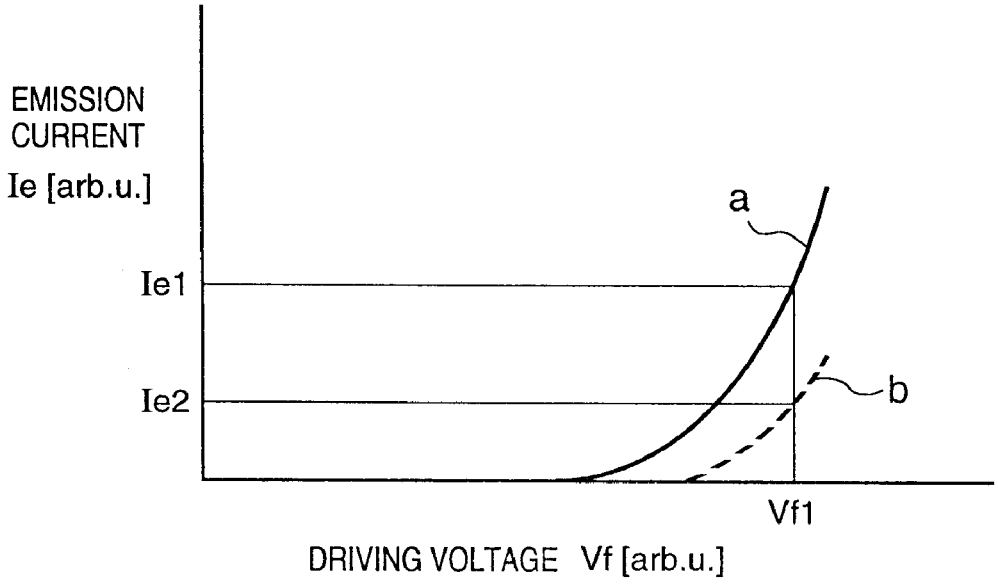
FIG. 4 is a graph showing the emission current characteristics of emission devices having different electron-emitting characteristics generated in a process of manufacturing the multi-electron-beam source, which are observed upon changing the driving voltage.

FIG. 4 is a graph showing the emission current characteristics of surface-conduction emission devices having different emission characteristics generated in a process of manufacturing the multi-electron-beam source of the display panel 1 of this embodiment, which are observed upon changing the driving voltage (the peak value of the driving pulse).

Referring to FIG. 4, the electron-emitting characteristic of a certain surface-conduction emission device is represented by a performance curve (a), and that of another surface-conduction emission device is represented by a performance curve (b). Therefore, the emission current at the driving voltage Vf1 is Ie1 for the electron-emitting device having the characteristic (a), and Ie2 for the electron-emitting device having the characteristic (b) (Ie1>Ie2).

As described above, the surface-conduction emission device of the present invention has an emission current characteristics corresponding to the maximum peak value of the driving pulses of the voltages applied previously.

Figure 5:
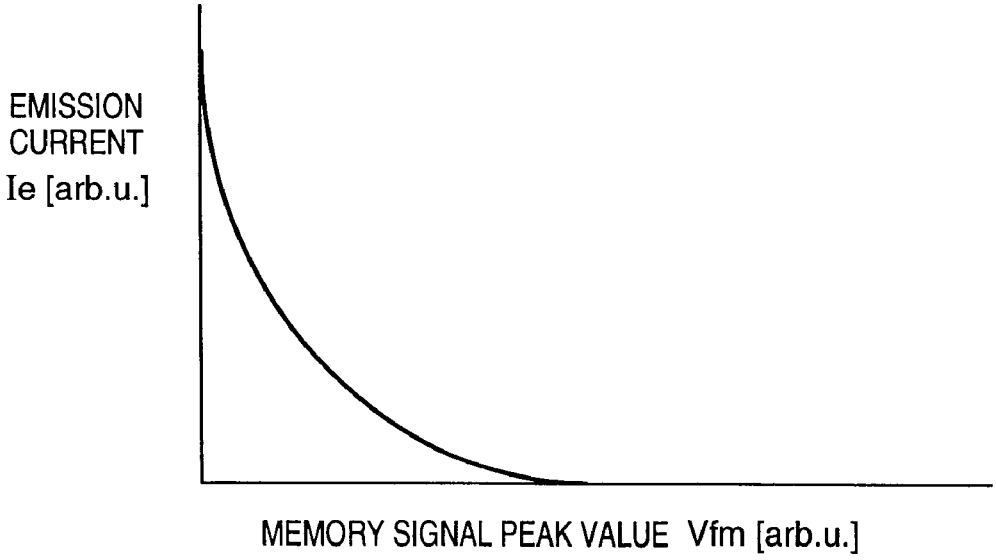
FIG. 5 is a graph showing the electron emission current characteristic observed upon changing the peak value of the memory waveform signal.

In FIG. 5, when a maximum value Vfm of the waveform signal for the memory function is changed, and the device is driven by a signal having a predetermined peak value smaller than the value Vfm. Therefore, the electron-emitting characteristics can be equalized by applying appropriate pulses (to be referred to as a memory waveform signal hereinafter) having different maximum peak values to the respective surface-conduction emission devices.

In FIG. 4, to equalize the characteristics of the emission device exhibiting the emission characteristic curve (a) with those of the emission device exhibiting the emission characteristic curve (b), a memory waveform signal may be applied to the emission device exhibiting the characteristic curve (a) with reference to the characteristics shown in FIG. 5, thereby changing the emission current Ie at the driving voltage Vf1 from Ie1 to Ie2.

In other words, in order to equalize the electron-emitting characteristic of a plurality of electron emission devices, an electrical characteristic curve (Vf-Ie) of one device is shifted towards the right in the graph (FIG. 2A), aiming at the characteristic of a device whose characteristic curve is located furthest to the right as a target (reference), thereby matching with the target. In this case, a level of a memory voltage waveform (i.e. shift voltage) to be applied to each of the electron emission devices is determined according to a difference from the target. The larger the difference from the target is (e.g. when the difference between Ie1 and Ie2 in FIG. 4 is large), that is, the more to the left the characteristic curve of the device is located in the graph, the larger the amount it has to be shifted.

Meanwhile, in order to determine how a characteristic curve shifts towards the right in accordance with a level of a shift voltage applied to the electron emission device having an initial characteristic, the experiment described above with reference to FIGS. 1A to 2B is performed a plurality of times. Herein, an experiment is conducted by selecting electron emission devices each of which has a different initial characteristic, various levels of voltage Vf2 are applied to each of the devices, and resulting data is stored. Note that in the apparatus shown in FIG. 3, these data are stored in the control circuit 9 in advance as a look-up table.

FIG. 5 shows a graph generated by picking up data from the look-up table for the electron emission device having an identical initial characteristic to that indicated by reference a in FIG. 4. The abscissa of the graph represents the level of shift voltage and the ordinate, an emission current Ie. The graph is obtained by applying a shift voltage to the device and further applying a driving voltage equal to the level of Vf1, and the emission current is measured. Therefore, to determine a level of shift voltage to be applied to the device having the characteristic a in FIG. 4, a value Vfm where Ie is equal to Ie2 in FIG. 5 is read.

Referring back to FIG. 7, a supplemental explanation will be provided below. In step S8 in FIG. 7, the control circuit 9 in FIG. 3 determines shift voltage (i.e. memory voltage) in the following steps.

A target electron emission device (reference) is first selected. More specifically, the measurement results of Ie for each electron emission device are compared to one another, and a device whose characteristic curve (Vf-Ie) is located furthest to the right in the graph (FIG. 2A) is selected from all the electron emission devices. The selected electron emission device will be referred to as a reference device hereinafter. Note that in a case where there are plural devices whose characteristic curves are located furthest to the right, these plural devices are considered as the reference device.

Next, memory voltage is determined in a unit of a device for the devices other than the reference device. The control circuit 9 reads data of a device having the most similar initial characteristic to a subject device, from the predeterminedly-stored look-up table.

From the read data, memory voltage for equalizing the characteristic of the subject device with that of the reference device is selected (cf. foregoing descriptions with regard to FIG. 5).

Memory voltage is determined for each of the devices in the foregoing manner and the result is stored in the memory 9*b* in step S9.

Since the characteristic curve needs not be shifted with respect to the reference device, discrimination information indicating that applying of memory voltage is not necessary is stored in the memory 9*b* in correspondence to the reference device. Alternatively, a voltage value lower than the measurement voltage applied in step S3 may be stored in the memory 9*b*.

A method of applying the memory waveform signal for equalizing the electron-emitting characteristics will be described below. In this case, the characteristics of the emission device exhibiting the emission characteristic curve (a) in FIG. 4 are changed to the electron-emitting characteristics represented by the characteristic curve (b). An example will be described with reference to the flow chart of FIG. 8, in which the emission current value at the predetermined driving voltage Vf1 is changed to Ie2.

Figure 8:
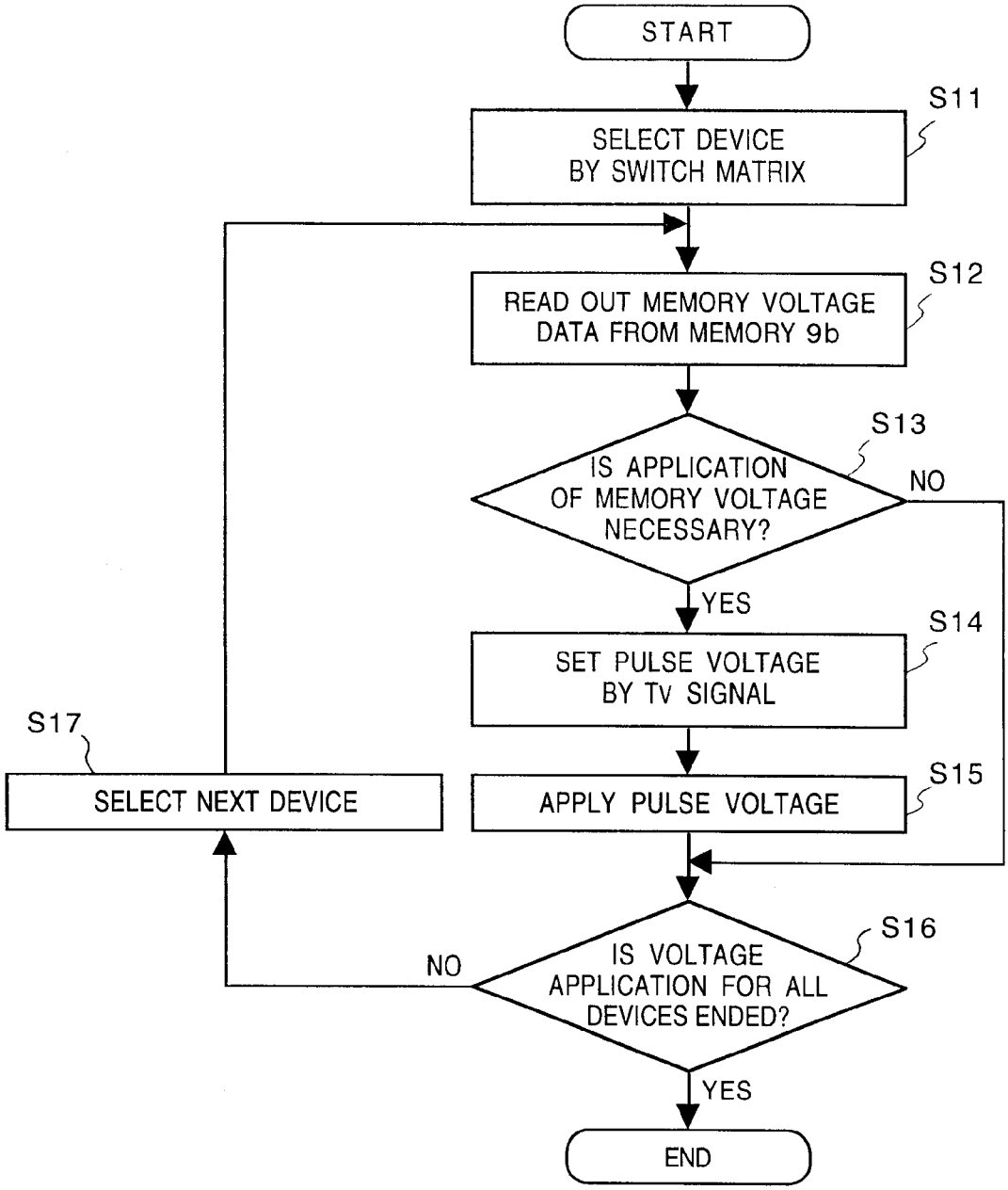
FIG. 8 is a flow chart showing a process of applying the memory waveform signal on the basis of the measured electron-emitting characteristics.

FIG. 8 is a flow chart showing the process of equalizing the electron-emitting characteristics of all the surface-conduction emission devices of the display panel 1, which is performed by the control circuit 9 of this embodiment.

In step S11, the switch matrixes 3 and 4 are controlled by the switch matrix control signal Tsw through the switch matrix control circuit 10, so that a surface-conduction emission device of the display panel 1, to which the memory waveform signal is to be applied, is selected. In step S12, the memory voltage data of the selected surface-conduction emission device is read out from the memory 9*b*. In step S13, it is determined whether it is necessary to apply the memory waveform signal to the surface-conduction emission device. When the characteristics are to be equalized with those represented by the characteristic curve (b) in FIG. 4, a surface-conduction emission device already having the characteristics represented by the characteristic curve (b) need not be applied with the memory waveform signal. Determination in step S13 is executed to prevent application of the memory waveform signal to such a surface-conduction emission device already having such characteristics.

If NO in step S13, the flow advances to step S16. If YES In step S13, the flow advances to step S14, and the peak value of the pulse signal is set by the pulse peak value setting circuit 8 on the basis of the peak value setting signal Tv. In step S15, the pulse peak value setting circuit 8 outputs the peak value data Lpx and Lpy. The pulse generators 6 and 7 respectively output the driving pulses Px and Py having the set peak values on the basis of the peak value data Lpx and Lpy. In this manner, the shift pulses (memory signal) corresponding to the characteristics of the surface-conduction emission device selected in step S11 are applied thereto. In step S16, it is checked whether the process for all the surface-conduction emission devices of the display panel 1 is completed. If NO in step S16, the flow advances to step S17, and the switch matrix control signal Tsw is output to select the next surface-conduction emission device to which the memory waveform signal is to be applied.

Figure 6:
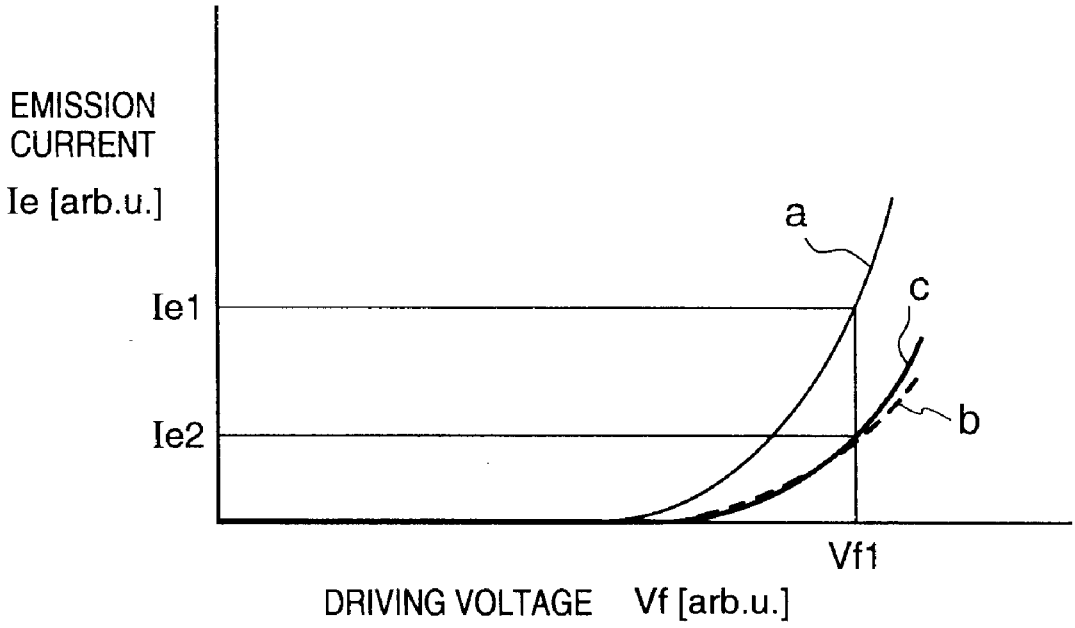
FIG. 6 is a graph for explaining the emission current characteristic of the emission device driven by a predetermined driving voltage Vf1 after application of the memory waveform signal.

Consequently, as shown in FIG. 6, the emission characteristic curve (a) of the surface-conduction emission device is changed to a characteristic curve (c). The emission current at the driving voltage Vf1 becomes Ie2. Therefore, the electron-emitting characteristics of all the surface-conduction emission devices of the display panel 1 can be equalized.

SECOND EMBODIMENT

The second embodiment of the present invention will be described next.

In the second embodiment, an electron emission characteristics of each surface conduction emission device is measured prior to actually usage of the surface conduction emission devices for displaying an image. If the electron emission characteristics of each device has variance, then the characteristics must be corrected to become uniform. The correction method has several steps, and a voltage to be added to each device in each step is set as follows. Particularly, $V_{measure}$, a driving voltage for measuring the device current characteristics of each device in a measuring step, $V_{shift}$, a characteristics shift voltage for adjusting the characteristics of each device to become uniform in an adjusting step, $V_{drive}$, a maximum voltage for driving the devices to display an image. Those voltages have a relation as shown below.

$$V_{drive}<VF_{measure}<V_{shift}$$

As shown above, since $VF_{measure}$ is higher than $V_{drive}$, a higher voltage is added to each surface conduction emission device in advance, than a driving voltage of displaying an image. Therefore, the characteristics of each device is kept from being changed by being added a higher voltage in an actual usage. Further, since $V_{shift}$ is set to be more higher than $VF_{measure}$, the shift characteristics voltage $V_{shift}$ is a maximum voltage to be added to each surface conduction emission device. Accordingly, the electron emission characteristics of each device can be corrected to a desired value by adding the $V_{shift}$. Furthermore, since $V_{shift}$ is set to be higher than $V_{drive}$, the characteristics of each device does not change in the actual usage after the characteristics of each device has been adjusted to be uniform.

Figure 9:
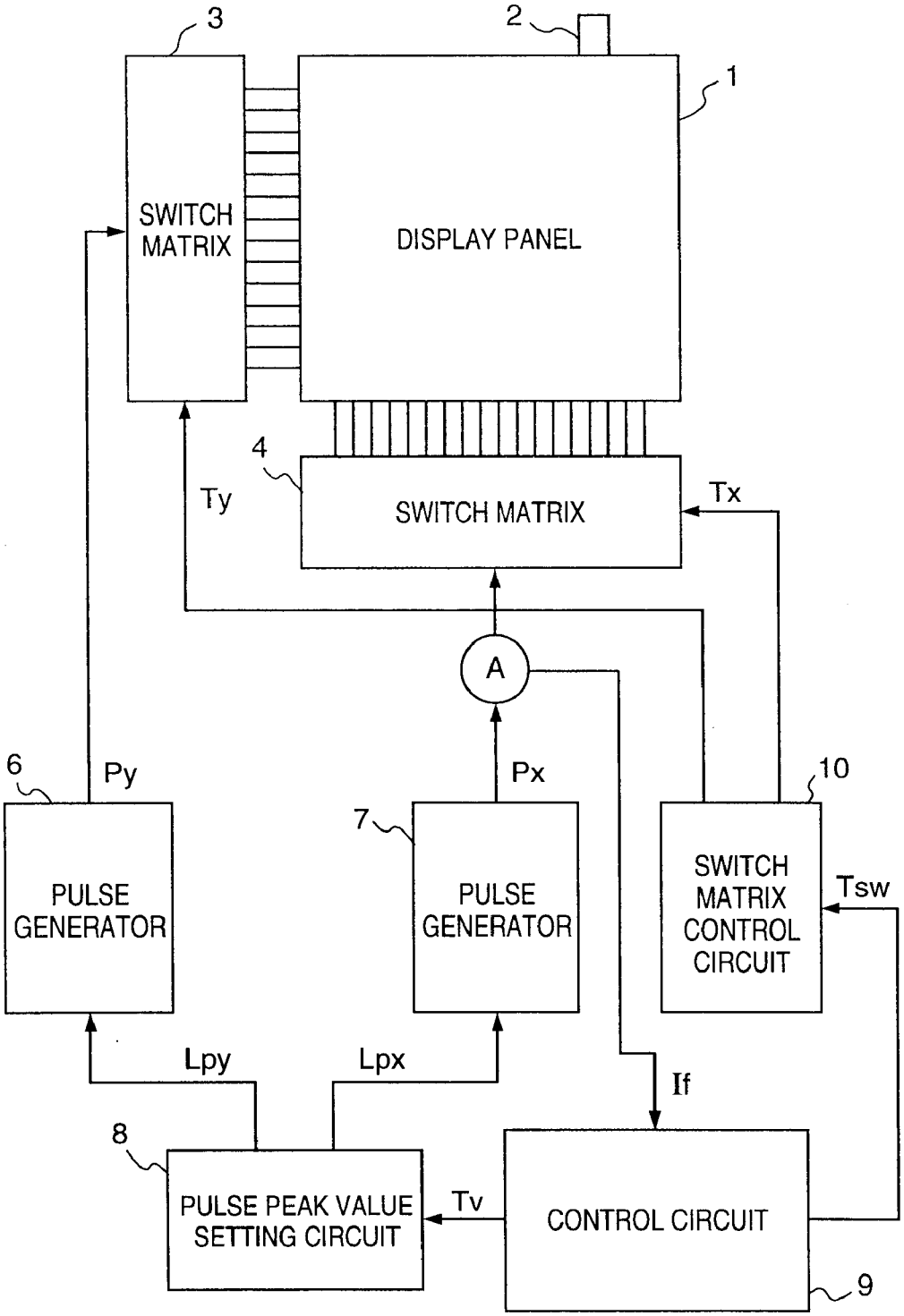
FIG. 9 is a block diagram showing the arrangement of an apparatus for applying a memory waveform signal to a multi-electron-beam source according to the second embodiment of the present invention.

FIG. 9 is a block diagram showing the arrangement of an apparatus for equalizing the electron-emitting characteristics of the surface-conduction emission devices of a display panel 1. The same reference numerals as in FIG. 3 denote the same elements in FIG. 9, and a detailed description thereof will be omitted.

In the second embodiment, an attention is paid to the strong correlation between a device current If and an emission current Ie with respect to a driving voltage Vf. This embodiment is different from that shown in FIG. 3 in that the device currents If are made uniform to equalize the electron emission currents Ie from the surface-conduction emission devices of the display panel 1, and for this purpose, a current detector 5 for measuring the device current If of each surface-conduction emission device is arranged. Reference numeral 9 denotes a control circuit corresponding to the control circuit 9.

Figure 10:
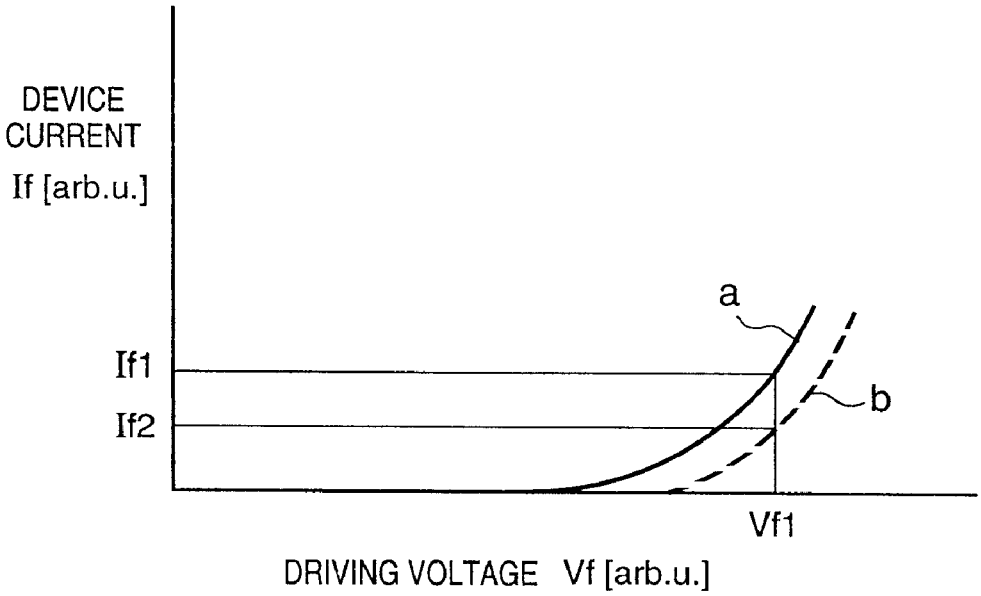
FIG. 10 is a graph showing the device current characteristics of emission devices having different electron-emitting characteristics generated in a process of manufacturing the multi-electron-beam source, which are observed upon changing a driving voltage.
Figure 11:
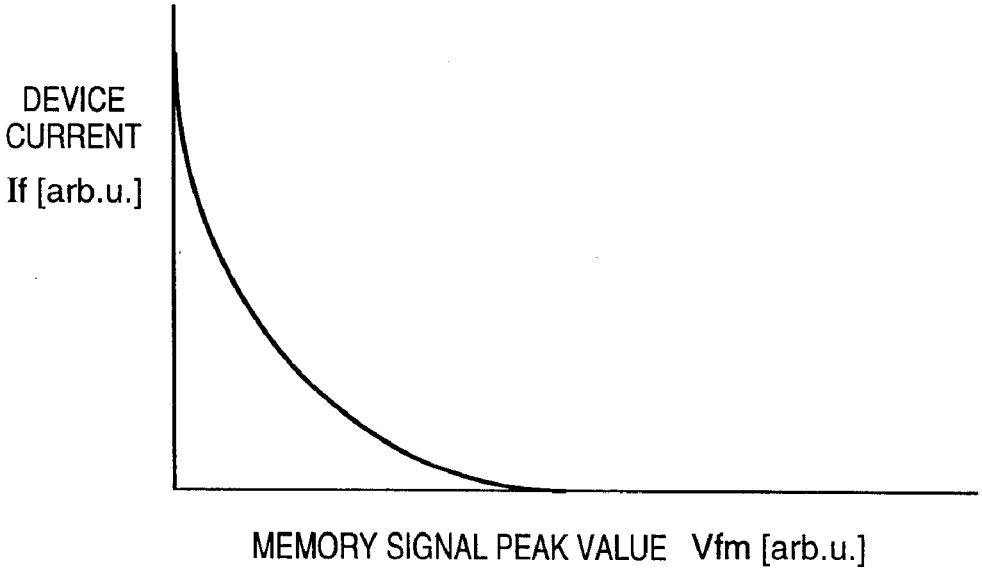
FIG. 11 is a graph showing the device current characteristic observed upon changing the peak value of the memory waveform signal.

FIG. 10 is a graph showing the device currents If as a function of the driving voltage Vf in surface-conduction emission devices having different emission characteristics generated in a process of manufacturing the multi-electron-beam source of the display panel 1. FIG. 11 is a graph showing the device current If observed when a maximum value Vfm of the memory waveform signal is changed, and the device is driven by a signal having a predetermined peak value smaller than the value Vfm. The emission current value Ie changes in units of surface-conduction emission devices. However, the emission characteristics can be equalized by applying the memory waveform signal to change the device current characteristic because the device current If and the emission current Ie have a strong correlation therebetween.

A method of equalizing the device currents If of the surface-conduction emission devices of the display panel 1 will be described below.

As for the operation of the circuit shown in FIG. 9, the measurement target in the second embodiment is the device current If, which differs from that in the first embodiment, i.e., the emission current Ie. Except for this point, the same operation as in the first embodiment can be performed to measure the device current before application of the memory waveform signal.

Figure 12:
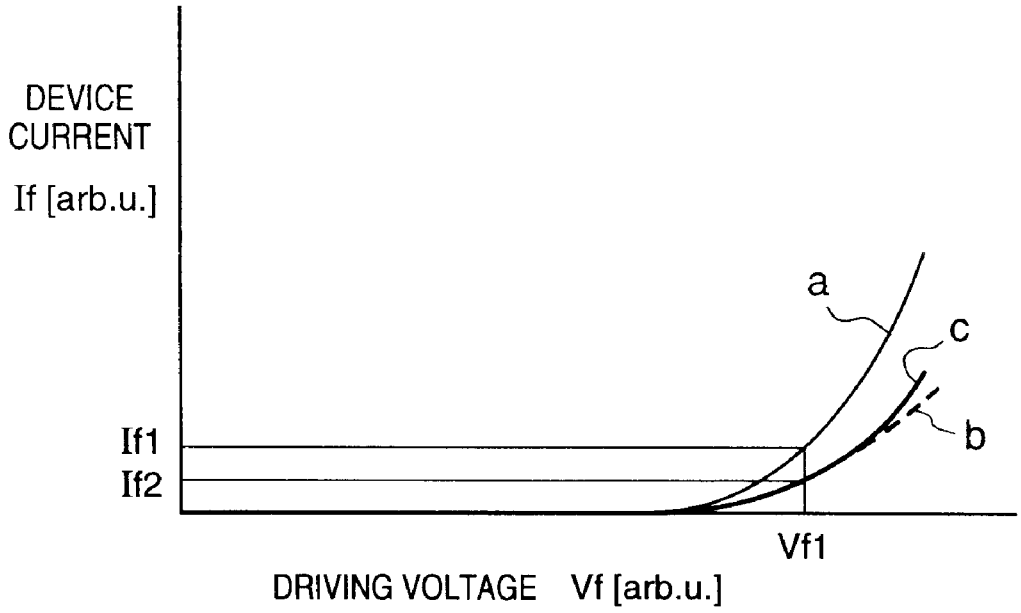
FIG. 12 is a graph for explaining the device current characteristic of the emission device driven by a predetermined driving voltage after application of the memory waveform signal.

Next, the memory waveform signal is applied to the emission device exhibiting a device current characteristic curve (a) in FIG. 10 with reference to the characteristic curve shown in FIG. 11 such that the device current is equalized with a predetermined device current (If2). Consequently, as shown in FIG. 12, the surface-conduction emission device which has exhibited the device current characteristic curve (a) so far exhibits a characteristic curve (c), so that the device current If2 which is the same as that of the surface-conduction emission device exhibiting the characteristic curve (b) can be obtained at the driving voltage Vf1. The device currents of all the surface-conduction emission devices of the display panel 1 can be equalized by performing the above operation for all the surface-conduction emission devices of the display panel 1.

When the display panel 1 which has obtained uniform characteristics upon application of the memory waveform signal in the above manner is driven by the driving voltage Vf having a value smaller than the peak value of the memory waveform signal for any device, the display panel 1 having surface-conduction emission devices all of which exhibit the uniform emission current Ie can be obtained.

In this manner, variations in emission currents of the surface-conduction emission devices of the display panel 1 can be eliminated, and image display with a uniform luminance distribution is enabled.

As for the operation of the second embodiment, detection of the emission current Ie in the flow chart of the first embodiment (FIGS. 7 and 8) is replaced with detection of the device current If to determine the peak value of the memory waveform signal. Therefore, the same operation as in the first embodiment can be performed, and a detailed description thereof will be omitted.

THIRD EMBODIMENT

The third embodiment of the present invention will be described below.

In the third embodiment, a luminance of light emitted from each phosphor corresponding to each surface conduction emission device is measured prior to actually usage of the surface conduction emission devices for displaying an image. If the luminance of each phosphor has variance, then the luminance characteristics must be corrected to become uniform. The correction method has several steps, and a voltage to be added to each device in each step is set as follows. Particularly, $VL_{measure}$, a driving voltage for measuring the luminance of each phosphor in a measuring step, $V_{shift}$, a characteristics shift voltage for adjusting the luminance of each phosphor to become uniform in an adjusting step, $V_{drive}$, a maximum voltage for driving the devices to display an image. Those voltages have a relation as shown below.

$$V_{drive}<VL_{measure}<V_{shift}$$

As shown above, since $VL_{measure}$ is higher than $V_{drive}$, a higher voltage is added to each surface conduction emission device in advance, than a driving voltage of displaying an image. Therefore, the characteristics of each device is kept from being changed by being added a higher voltage in an actual usage. Further, since $V_{shift}$ is set to be more higher than $VL_{measure}$, the shift characteristics voltage $V_{shift}$ is a maximum voltage to be added to each surface conduction emission device. Accordingly, the electron emission characteristics of each device can be corrected to a desired value by adding the $V_{shift}$. Furthermore, since $V_{shift}$ is set to be higher than $V_{drive}$, the characteristics of each device does not change in the actual usage after the luminance of each phosphor has been adjusted to be uniform.

Figure 13:
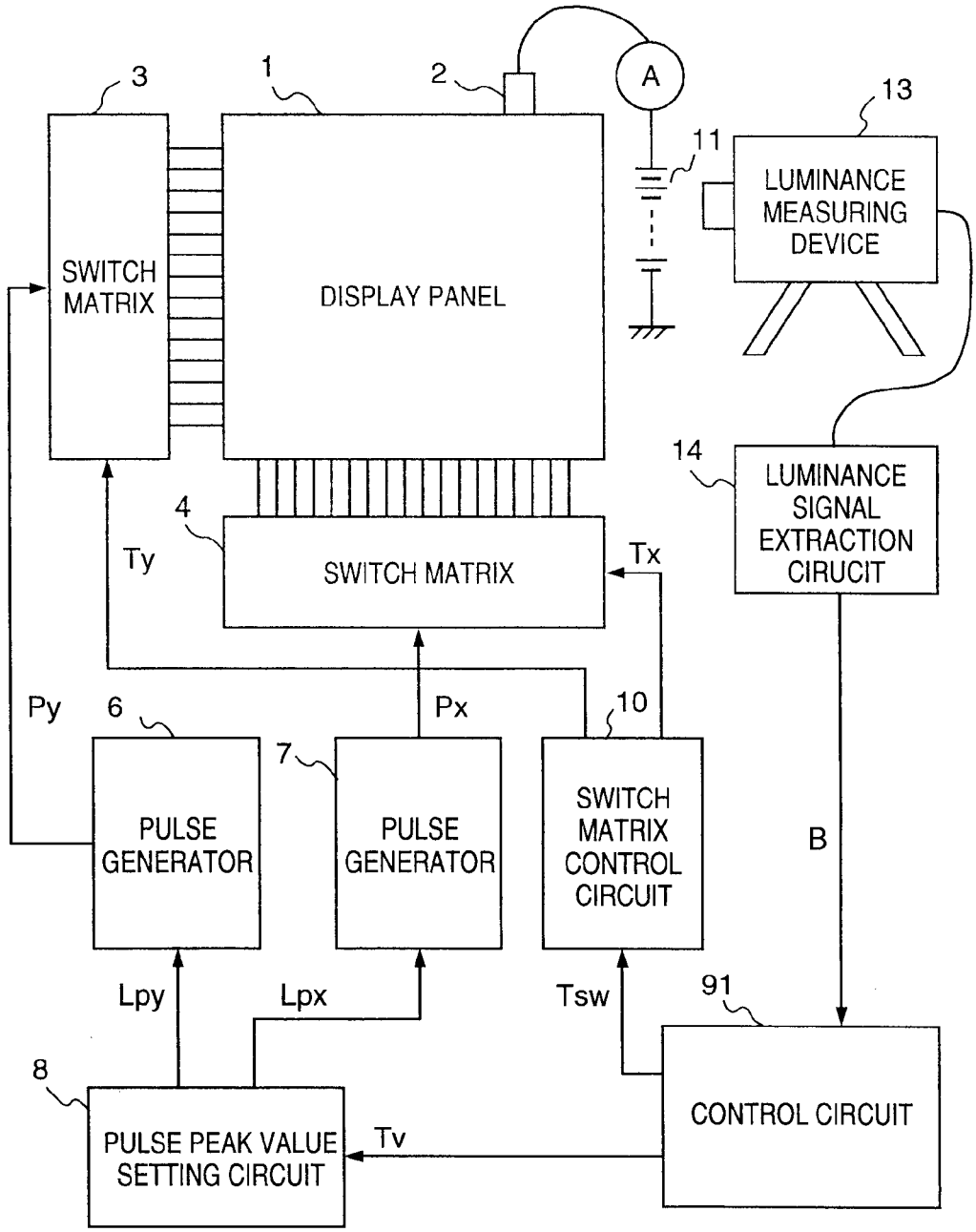
FIG. 13 is a block diagram showing the arrangement of an apparatus for applying a memory waveform signal to a multi-electron-beam source according to the third embodiment of the present invention.

FIG. 13 is a block diagram showing the arrangement of an apparatus for changing the electron-emitting characteristics of surface-conduction emission devices of a display panel 1 according to the third embodiment of the present invention. The same reference numerals as in FIG. 3 or 9 denote the same elements in FIG. 13, and a detailed description thereof will be omitted.

This apparatus equalizes the light emission luminance of phosphors corresponding to the respective emission devices. The apparatus shown in FIG. 13 is different from that shown in FIG. 3 in that, in place of the current detector 12 for measuring the emission current Ie, a luminance measuring device 13 for measuring the light emission luminance of a phosphor and a luminance signal extraction circuit 14 for converting the measured luminance into an emission current Ie or device current If corresponding to the luminance data are arranged.

A method of equalizing the luminance at the wave crests of phosphors corresponding to the respective emission devices by using such an apparatus will be described below.

Since the light emission luminance of a phosphor can be regarded as proportional to the emission current Ie, the electron-emitting characteristics may be changed in accordance with a variation in measured light emission luminance. More specifically, luminance data measured by the luminance measuring device 13 is converted into a value B corresponding to the emission current Ie or device current If of the emission device by the luminance signal extraction circuit 14, and the value B is output to a control circuit 91. As in the method described in the first and second embodiments, the emission current Ie or device current If at a predetermined driving voltage Vf is changed. This case differs from the first and second embodiments in that a variation in luminance, including a partial variation in light emission characteristics of the phosphor, is corrected. The device currents of all the surface-conduction emission devices of the display panel 1 can be equalized by performing the above operation for all the emission devices.

The process by the control circuit 91 in the third embodiment can be performed as in the first embodiment (the flow charts of FIGS. 7 and 8), and a detailed description thereof will be omitted.

When the display panel 1 whose all the surface-conduction emission devices have obtained uniform electron-emitting characteristics upon application of the memory waveform signal in the above manner is driven by the driving voltage Vf having a value smaller than the peak value of the memory waveform signal for any surface-conduction emission device, the display panel 1 capable of obtaining a uniform light emission luminance in all the display areas can be provided.

Figure 14:
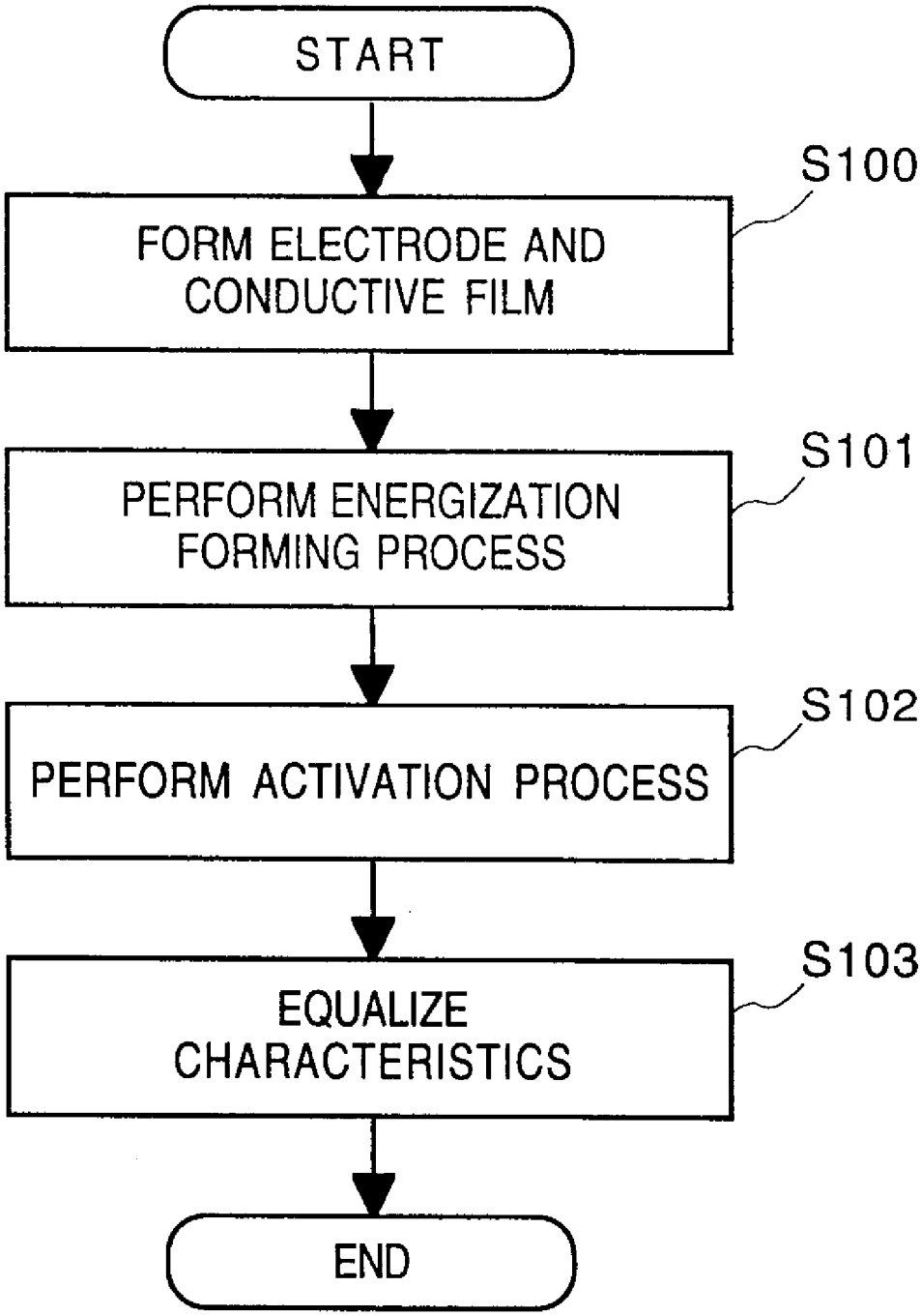
FIG. 14 is a flow chart showing steps in manufacturing the multi-electron-beam source of the present invention.

FIG. 14 is a flow chart showing steps in manufacturing the multi-electron-beam source of the display panel of the present invention.

In step S100, electrodes and a conductive thin film are formed on a substrate, as will be described later. In step S101, a voltage is applied between the electrodes to form an electron-emitting portion. In step S102, electrification is performed for the electron-emitting portion to perform an activation process. A basic multi-electron-beam source is completed in this manner. Additionally, an equalization process for equalizing the characteristics of all the surface-conduction emission devices, which is the feature of the present invention, is performed (step S103), a uniform luminance can be obtained in all the areas of the display panel.

(Arrangement and Manufacturing Method of Display Panel of This Embodiment)

The arrangement and manufacturing method of the display panel of an image display apparatus to which the present invention is applied will be described below with reference to a detailed example.

Figure 15:
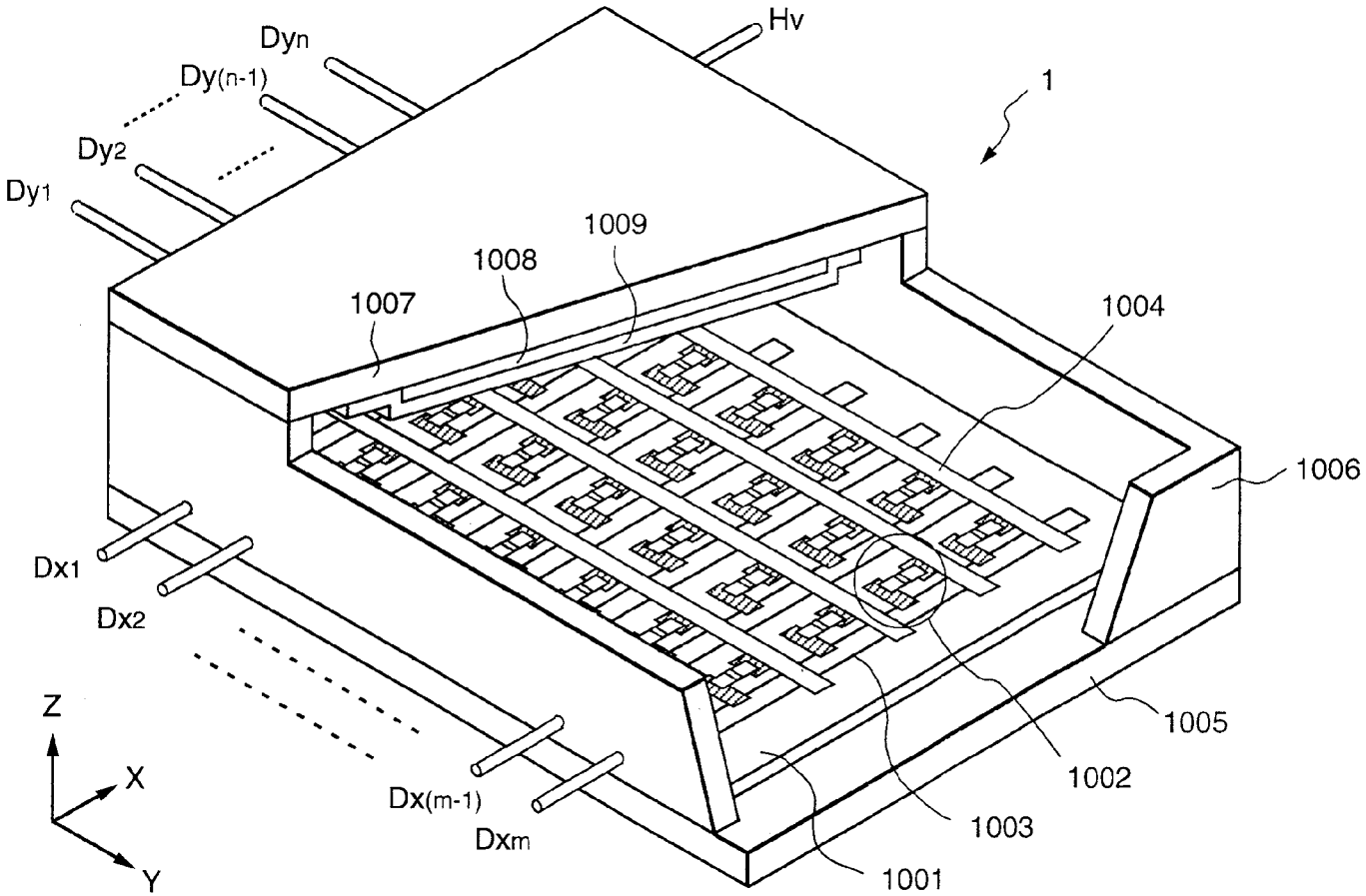
FIG. 15 is a partially cutaway perspective view showing the display panel of an image display apparatus of the present invention.

FIG. 15 is a partially cutaway perspective view of a display panel 1 used in the present invention, showing the internal structure of the panel.

Referring to FIG. 15, reference numeral 1005 denotes a rear plate; 1006, a side wall; and 1007, a face plate. These parts 1105 to 1007 form an airtight vessel for maintaining a vacuum in the display panel 1. To construct the airtight vessel, it is necessary to seal-connect the respective parts to allow their junction portions to hold a sufficient strength and airtight condition. For example, frit glass is applied to the junction portions and sintered at 400° C. to 500° C. in air or a nitrogen atmosphere for 10 minutes or more, thereby seal-connecting the parts. A method of evacuating the airtight vessel will be described later.

The rear plate 1005 has a substrate 1001 fixed thereon, on which N×M surface-conduction emission devices 1002 are formed. M and N are positive integers of 2 or more and appropriately set in accordance with a target number of display pixels. For example, in a display apparatus for high-definition television display, preferably N=3,000 or more, and M=1,000 or more. In the present invention, N=3,071, and M=1,024. The N×M surface-conduction emission devices are arranged in a simple matrix with M row wiring layers 1003 and N column wiring layers 1004. The portion constituted by the parts 1001 to 1004 will be referred to as a multi-electron-beam source. The manufacturing method and structure of the multi-electron-beam source will be described later in detail.

In the present invention, the substrate 1001 of the multi-electron-beam source is fixed to the rear plate 1005 of the airtight vessel. However, if the substrate 1001 of the multi-electron-beam source has a sufficient strength, the substrate 1001 itself of the multi-electron-beam source may be used as the rear plate of the airtight vessel.

Figure 16A:
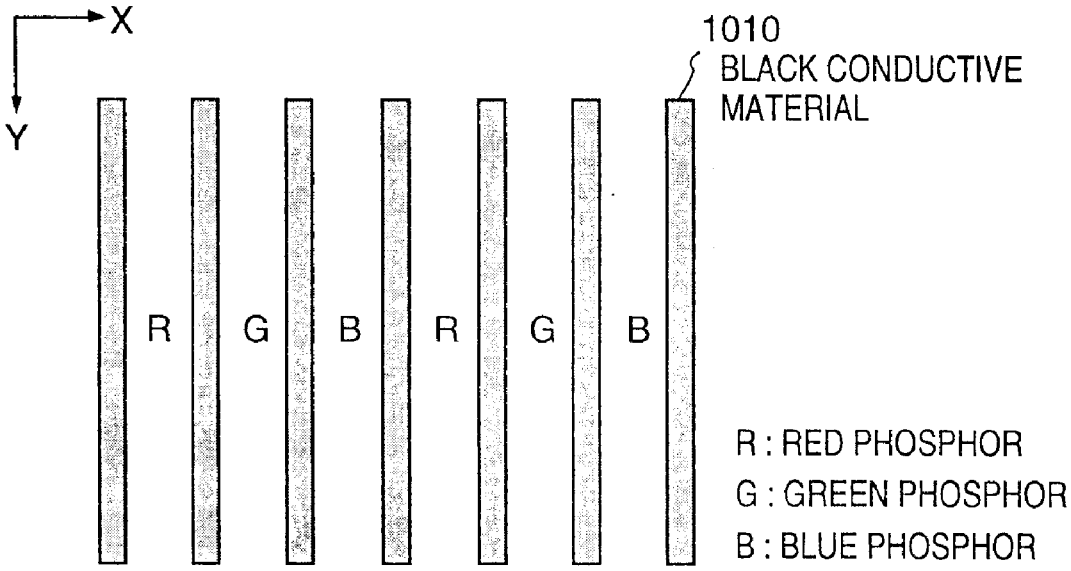
FIGS. 16A and 16B are plan views showing the arrangements of phosphors on the face plate of the display panel of the present invention.

Furthermore, a phosphor film 1008 is formed on the lower surface of the face plate 1007. As the display panel 1 of this embodiment is a display panel for a color display apparatus, the phosphor film 1008 is coated with red (R), green (G), and blue (B) phosphors, i.e., three primary color phosphors used in the CRT field. As shown in FIG. 16A, the R, G, and B phosphors are applied in a striped arrangement. A black conductive material 1010 is provided between the stripes of the phosphors. The purpose of providing the black conductive material 1010 is to prevent display color misregistration even if the electron beam irradiation position is shifted to some extent, to prevent degradation of display contrast by shutting off reflection of external light, to prevent charge-up of the phosphor film 1008 by electron beams, and the like. The black conductive material 1010 mainly consists of graphite, though any other material may be used as long as the above purpose can be attained.

Figure 16B:
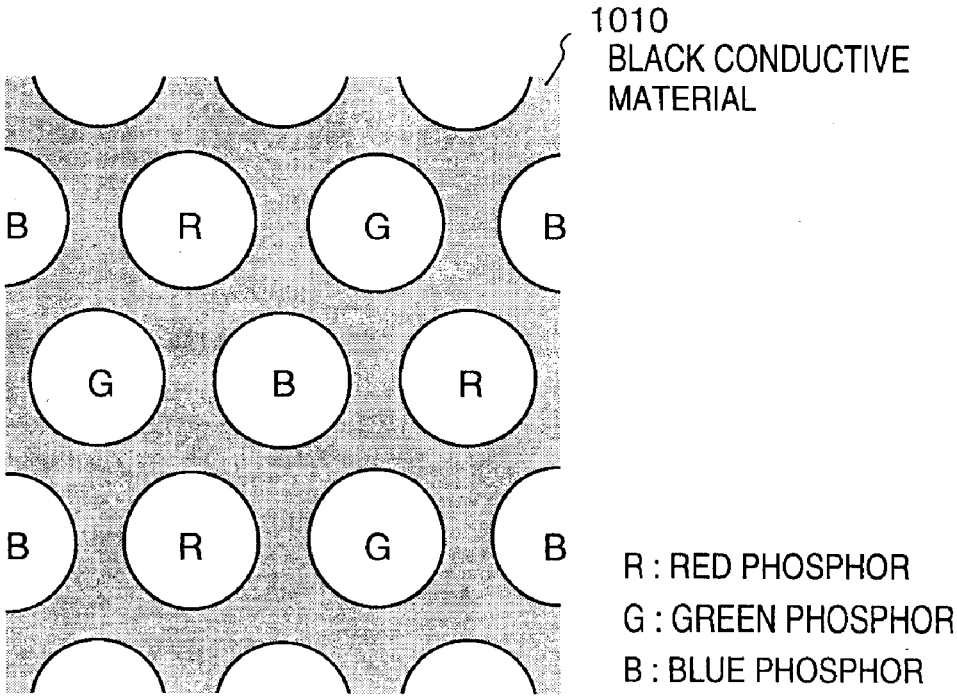

The arrangement of the phosphors of the three primary colors, i.e., R, G, and B is not limited to the striped arrangement shown in FIG. 16A. For example, a delta arrangement shown in FIG. 16B or other arrangements may be employed.

When a monochromatic display panel is to be formed, a monochromatic phosphor material must be used for the phosphor film 1008. In this case, the black conductive material need not always be used.

Furthermore, a metal back 1009, which is well-known in the CRT field, is provided on the rear plate side surface of the phosphor film 1008. The purpose of providing the metal back 1009 is to improve the light-utilization ratio by mirror-reflecting part of light emitted from the phosphor film 1008, to protect the phosphor film 1008 from collision with negative ions, to use the metal back 1009 as an electrode for applying an electron beam accelerating voltage, to use the metal back 1009 as a conductive path of electrons which excited the phosphor film 1008, and the like. The metal back 1009 is formed by forming the phosphor film 1008 on the face plate 1007, applying a smoothing process to the phosphor film surface, and depositing aluminum (Al) thereon by vacuum deposition. Note that when a phosphor material for a low voltage is used for the phosphor film 1008, the metal back 1009 is not used.

Furthermore, for application of an accelerating voltage or improvement of the conductivity of the phosphor film, transparent electrodes made of, e.g., ITO may be provided between the face plate 1007 and the phosphor film 1008.

Terminals Dx1 to Dxm, Dy1 to Dyn, and Hv are electric connection terminals for an airtight structure provided to electrically connect the display panel 1 to an electric circuit (not shown). The terminals Dx1 to Dxm are electrically connected to the row wiring layers 1003 of the multi-electron-beam source; the terminals Dy1 to Dyn, to the column wiring layers 1004 of the multi-electron-beam source; and the terminal Hv, to the metal back 1009 of the face plate.

To evacuate the airtight vessel, after forming the airtight vessel, an exhaust pipe and a vacuum pump (neither are shown) are connected, and the airtight vessel is evacuated to a vacuum of about $10^{-7}$ [Torr]. Thereafter, the exhaust pipe is sealed. To maintain the vacuum in the airtight vessel, a getter film (not shown) is formed at a predetermined position in the airtight container immediately before/after the sealing. The getter film is a film formed by heating and evaporating a gettering material mainly consisting of, e.g., Ba, by heating or RF heating. The suction effect of the getter film maintains a vacuum of $1\times10^{-5}$ to $1\times10^{-7}$ [Torr] in the airtight vessel. In this case, the partial pressure of the organic gas mainly consisting of carbon and hydrogen and having a mass number of 13 to 200 is set to be smaller than $10^{-8}$ (Torr).

The basic arrangement and manufacturing method of the display panel 1 according to the present invention have been described above.

A method of manufacturing the multi-electron-beam source used in the display panel 1 of the present invention will be described next. For the multi-electron-beam source used in the image display apparatus of the present invention, any material, shape, and manufacturing method of the surface-conduction emission device may be employed so long as it is for a multi-electron-beam source having surface-conduction emission devices arranged in a simple matrix. However, the present inventors have found that among the surface-conduction emission devices, one having an electron-emitting portion or its peripheral portion consisting of a fine particle film is excellent in electron-emitting characteristic and can be easily manufactured. Accordingly, such a device is the most appropriate surface-conduction emission device to be employed in a high-brightness, large-screen image display apparatus. In the display panel of the present invention, the surface-conduction emission devices each having an electron-emitting portion or its peripheral portion made of a fine particle film are used. First, the basic structure, manufacturing method, and characteristic of the preferred surface-conduction emission device will be described, and the structure of the multi-electron-beam source having many devices wired in a simple matrix will be described later.

(Preferred Structure and Manufacturing Method of Surface-conduction Emission Device)

The typical structure of the surface-conduction emission device having an electron-emitting portion or its peripheral portion made of a fine particle film includes a plane type structure and a step type structure.

(Plane Type Surface-conduction Emission Device)

The structure and manufacturing method of a plane type surface-conduction emission device will be described first. This process corresponds to step S100 in FIG. 14.

Figure 17A:
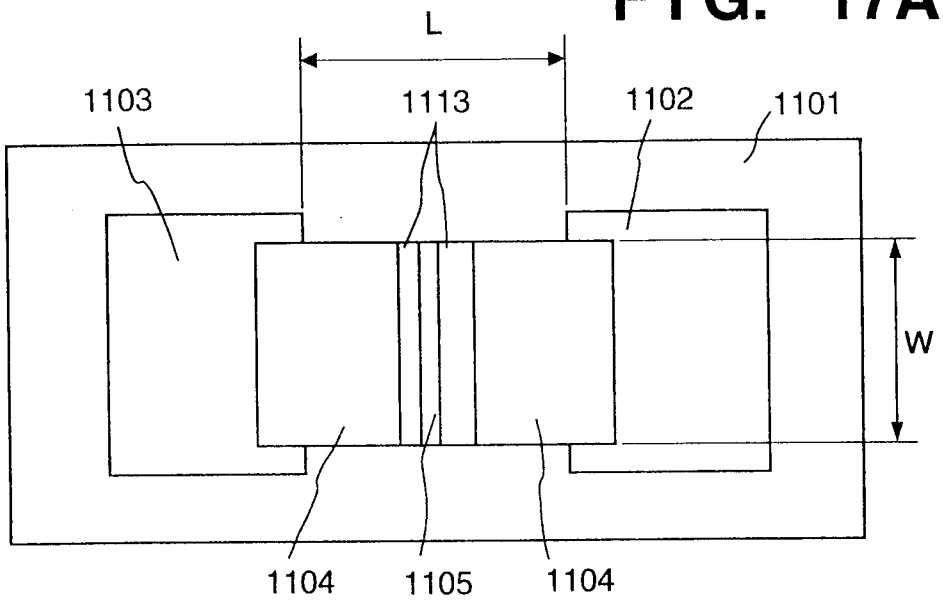
FIGS. 17A and 17B are plan and sectional views of a plane type surface-conduction emission device used in the present invention.
Figure 17B:
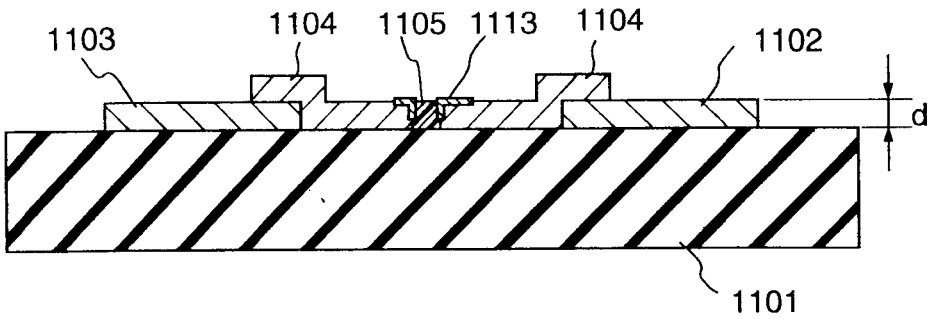

FIGS. 17A and 17B are plan and sectional views for explaining the structure of the plane type surface-conduction emission device.

Referring to FIGS. 17A and 17B, reference numeral 1101 denotes a substrate; 1102 and 1103, device electrodes; 1104, a conductive thin film; 1105, an electron-emitting portion formed by a energization forming process; and 1113, a thin film formed by an activation process.

As the substrate 1101, various glass substrates of, e.g., silica glass and soda-lime glass, various ceramic substrates of, e.g., alumina, or any of those substrates with an insulating layer consisting of, e.g., $SiO_2$ and formed thereon can be employed. The device electrodes 1102 and 1103 formed on the substrate 1101 to be parallel to its surface and oppose each other are made of a conductive material. For example, one of the following materials may be selected and used: metals such as Ni, Cr, Au, Mo, W, Pt, Ti, Cu, Pd, and Ag, alloys of these materials, metal oxides such as $In_2O_3$—$SnO_2$, and semiconductors such as polysilicon. The device electrodes 1102 and 1103 can be easily formed by the combination of a film-forming technique such as vacuum deposition and a patterning technique such as photolithography or etching, however, any other method (e.g., a printing technique) may be employed.

The shape of the device electrodes 1102 and 1103 is appropriately designed in accordance with an application purpose of the electron-emitting device. Generally, an electrode spacing L is designed to be an appropriate value in a range from several hundreds Å to several hundreds $\mu$m. The most preferably range for a display apparatus is from several $\mu$m to several tens $\mu$m. As for a thickness d of the device electrodes, an appropriate value is generally selected from a range from several hundreds Å to several $\mu$m.

The conductive thin film 1104 is made of a fine particle film. The "fine particle film" is a film which contains a lot of fine particles (including an insular aggregate). Microscopic observation of the fine particle film will reveal that the individual fine particles in the film are spaced apart from each other, adjacent to each other, or overlap each other. One particle in the fine particle film has a diameter within a range from several Å to several thousands Å. Preferably, the diameter falls within a range from 10 Å to 200 Å. The thickness of the fine particle film is appropriately set in consideration of the following conditions: a condition necessary for electrical connection to the device electrode 1102 or 1103, a condition for the energization forming process to be described later, a condition for setting the electric resistance of the fine particle film itself to an appropriate value to be described later. More specifically, the thickness of the film is set in a range from several Å to several thousands Å, and more preferably, 10 Å to 500 Å.

For example, materials used for forming the fine particle film are metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, HfN, semiconductors such as Si and Ge, and carbons. An appropriate material is selected from these materials.

As described above, the conductive thin film 1104 is formed using a fine particle film, and the sheet resistance of the film is set to fall within a range from $10^3$ to $10^7$ [Ω/sq].

As it is preferable that the conductive thin film 1104 is electrically connected to the device electrodes 1102 and 1103, they are arranged so as to partly overlap each other. Referring to FIGS. 17A and 17B, the respective parts are stacked in the following order from the bottom: the substrate, the device electrodes, and the conductive thin film. This overlapping order may be: the substrate, the conductive thin film, and the device electrodes, from the bottom.

The electron-emitting portion 1105 is a fissure portion formed at a part of the conductive thin film 1104. The electron-emitting portion 1105 has an electric resistance higher than that of the peripheral conductive thin film. The fissure portion is formed by the energization forming process (to be described later) on the conductive thin film 1104. In some cases, particles, having a diameter of several Å to several hundreds Å, are arranged within the fissure portion. As it is difficult to exactly illustrate the actual position and shape of the electron-emitting portion, FIGS. 17A and 17B show the fissure portion schematically.

The thin film 1113, which consists of carbon or a carbon compound, covers the electron-emitting portion 1105 and its peripheral portion. The thin film 1113 is formed by the activation process to be described later after the energization forming process.

The thin film 1113 is preferably made of monocrystalline graphite, polycrystalline graphite, amorphous carbon, or a mixture thereof, and its thickness is 500 [Å] or less, and more particularly, 300 [Å] or less.

As it is difficult to exactly illustrate the actual position or shape of the thin film 1113, FIGS. 17A and 17B show the film schematically. FIG. 17A is a plan view showing the device in which a part of the thin film 1113 is removed.

The preferred basic structure of the device has been described above. In the present invention, actually, the following device is used.

The substrate 1101 consists of soda-lime glass, and the device electrodes 1102 and 1103, an Ni thin film. The thickness d of the device electrodes is 1,000 [Å], and the electrode spacing L is 2 [μm].

As the main material for the fine particle film, Pd or PdO is used. The thickness and width W of the fine particle film are respectively set to about 100 [Å] and 100 [μm].

A preferred method of manufacturing the plane type surface-conduction emission device will be described next. FIGS. 18A to 18D are sectional views for explaining steps in manufacturing the plane type surface-conduction emission device. The same reference numerals as in FIGS. 17A and 17B denote the same parts in FIGS. 18A to 18D, and a detailed description thereof will be omitted.

Figure 18A:
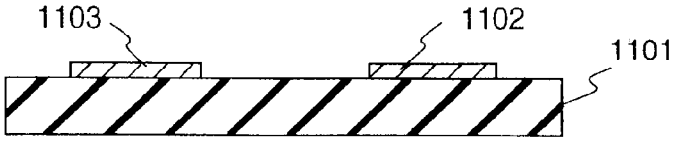
FIGS. 18A to 18E are sectional views showing steps in manufacturing the plane type surface-conduction emission device.

(1) First, as shown in FIG. 18A, the device electrodes 1102 and 1103 are formed on the substrate 1101. In forming the device electrodes 1102 and 1103, the substrate 1101 is fully cleaned with a detergent, pure water, and an organic solvent, and a material for the device electrodes is deposited on the substrate 1101. As a method of depositing the material, a vacuum film-forming technique such as vapor deposition or sputtering may be used. Thereafter, the deposited electrode material is patterned by a photolithographic etching technique. Thus, the pair of device electrodes (1102 and 1103) in FIG. 18A are formed.

Figure 18B:
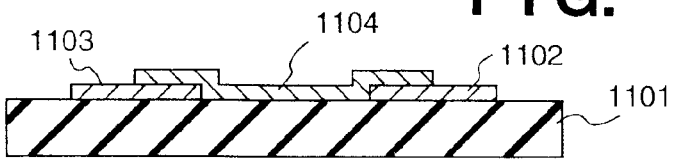

(2) Next, as shown in FIG. 18B, the conductive thin film 1104 is formed.

In forming the conductive thin film, an organic metal solution is applied to the substrate in FIG. 18A first, and the applied solution is then dried and sintered, thereby forming a fine particle film. Thereafter, the fine particle film is patterned into a predetermined shape by the photolithographic etching method. The organic metal solution means an organic metal compound solution containing a material for fine particles, used for the conductive thin film, as main element. In the present invention, Pd is used as the main element. In the present invention, application of an organic metal solution is performed by a dipping method, however, a spinner method or spraying method may be used.

As a method of forming the conductive thin film made of the fine particle film, the application of an organic metal solution used in the present invention can be replaced with any other method such as a vacuum deposition method, a sputtering method, or a chemical vapor deposition method.

Figure 18C:
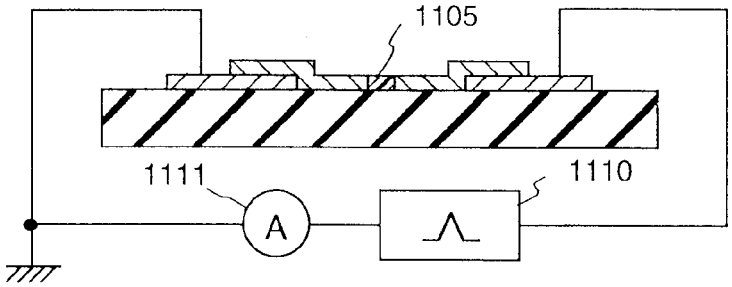

(3) As shown in FIG. 18C, an appropriate voltage is applied between the device electrodes 1102 and 1103, from a power supply 1110 for the energization forming process, and the energization forming process is performed to form the electron-emitting portion 1105 (this process corresponds to the energization forming process in FIG. 14). The energization forming process here is a process of performing electrification for the conductive thin film 1104 made of a fine particle film to appropriately destroy, deform, or deteriorate a part of the conductive thin film, thereby changing the film into a structure suitable for electron emission. In the conductive thin film made of the fine particle film, the portion changed into the structure suitable for electron emission (i.e., the electron-emitting portion 1105) has an appropriate fissure in the thin film. Comparing the thin film having the electron-emitting portion 1105 with the thin film before the energization forming process, the electric resistance measured between the device electrodes 1102 and 1103 has greatly increased.

Figure 19:
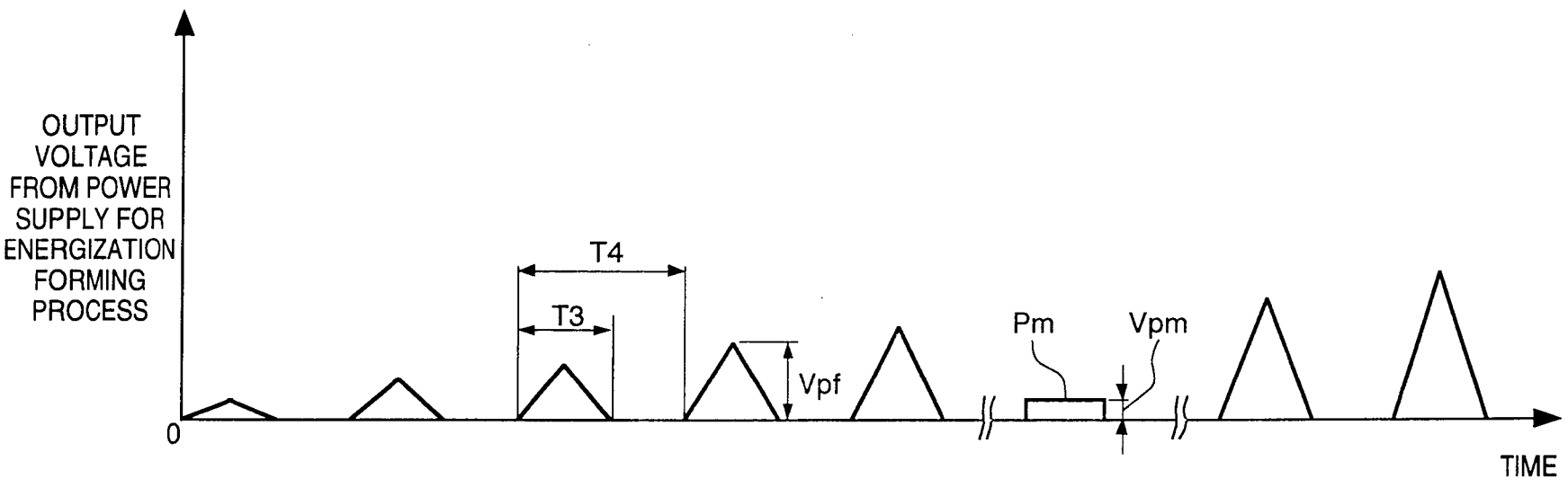
FIG. 19 is a chart showing the waveforms of applied voltages in a energization forming process.

An electrification method for the energization forming process will be described in detail with reference to FIG. 19 showing an example of the waveform of an appropriate voltage applied from the power supply 1110 for the energization forming process.

In the energization forming process to the conductive thin film made of a fine particle film, a pulse-like voltage is preferably employed. In the present invention, as shown in FIG. 19, a triangular pulse having a pulse width T3 is continuously applied at a pulse interval T4. In this case, a peak value Vpf of the triangular pulse is sequentially increased. Furthermore, a monitor pulse Pm is inserted between the triangular pulses at appropriate intervals to monitor the formed state of the electron-emitting portion 1105, and the current that flows at the insertion is measured by an ammeter 1111.

In this embodiment, in a $10^{-5}$ [Torr] vacuum atmosphere, the pulse width T3 is set to 1 [msec]; and the pulse interval T4, to 10 [msec]. The peak value Vpf is increased by 0.1 [V], at each pulse. Each time five triangular pulses are applied, one monitor pulse Pm is inserted. To avoid adverse effects on the energization forming process, a voltage Vpm of the monitor pulse is set to 0.1 [V]. When the electric resistance between the device electrodes 1102 and 1103 becomes $1\times10^{-6}$ [Ω], i.e., the current measured by the ammeter 1111 upon application of the monitor pulse becomes $1\times10^{-7}$ [A] or less, electrification for the energization forming process is terminated.

Note that the above method is preferable to the surface-conduction emission device of the present invention. In case of changing the design of the surface-conduction emission device concerning, e.g., the material or thickness of the fine particle film, or the spacing L between the device electrodes, the conditions for electrification are preferably changed in accordance with the change in device design.

Figure 18D:
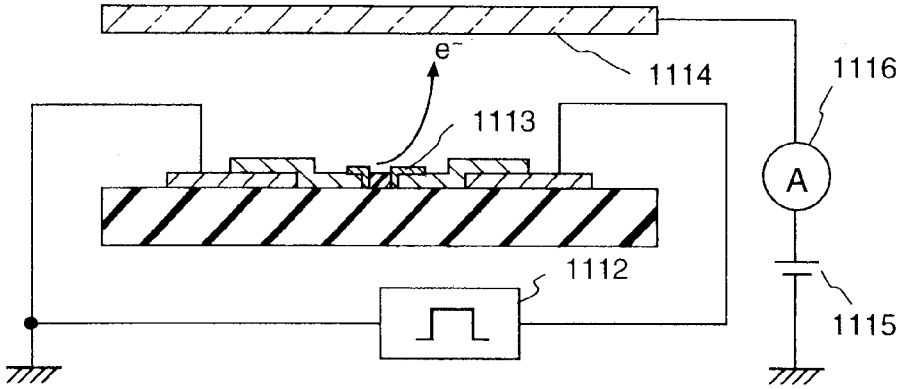

4) As shown in FIG. 18D, an appropriate voltage is applied next, from an activation power supply 1112, between the device electrodes 1102 and 1103, and the activation process is performed to improve the electron-emitting characteristic (this process corresponds to step S102 in FIG. 14). The activation process here is a process of performing electrification of the electron-emitting portion 1105 formed by the energization forming process, under appropriate conditions, to deposit a carbon or carbon compound around the electron-emitting portion 1105 (FIG. 18D shows the deposited material of the carbon or carbon compound as the material 1113). Comparing the electron-emitting portion 1105 with that before the activation process, the emission current at the same applied voltage can be increased typically 100 times or more.

The activation process is performed by periodically applying a voltage pulse in a $10^{-2}$ to $10^{-5}$ [Torr] vacuum atmosphere to deposit a carbon or carbon compound mainly derived from an organic compound existing in the vacuum atmosphere. The deposition material 1113 is any of monocrystalline graphite, polycrystalline graphite, amorphous carbon, and a mixture thereof. The thickness of the deposition material 1113 is 500 [Å] or less, and more preferably, 300 [Å] or less.

Figure 20A:
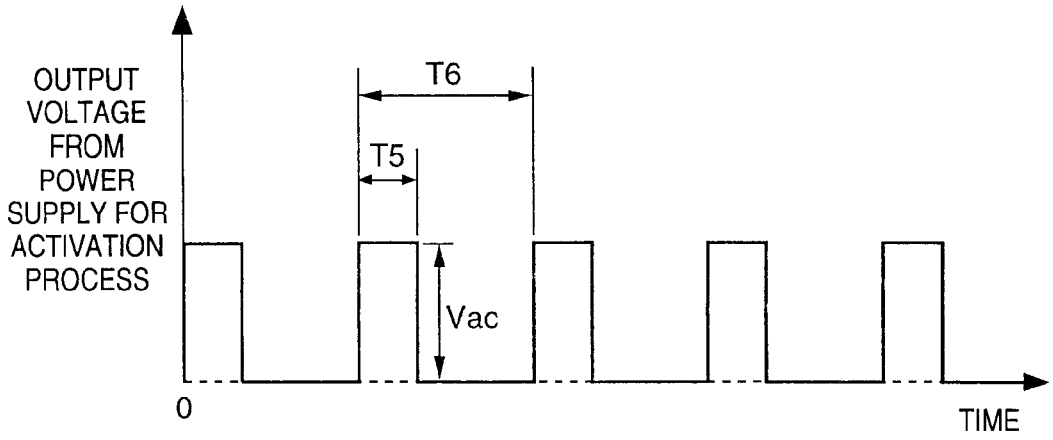
FIGS. 20A and 20B are charts respectively showing the waveforms of an applied voltage and a change in emission current Ie in an activation process.

FIG. 20A shows an example of the waveform of an appropriate voltage applied from the activation power supply 1112 so as to explain the electrification method in the activation process in more detail. In the present invention, the activation process is performed by periodically applying a constant rectangular voltage. More specifically, a rectangular voltage Vac shown is set to 14 [V]; a pulse width T5, to 1 [msec]; and a pulse interval T6, to 10 [msec]. Note that the above electrification conditions are preferable to manufacture the surface-conduction emission device of the present invention. When the design of the surface-conduction emission device is changed, the conditions are preferably changed in accordance with the change in device design.

Figure 20B:
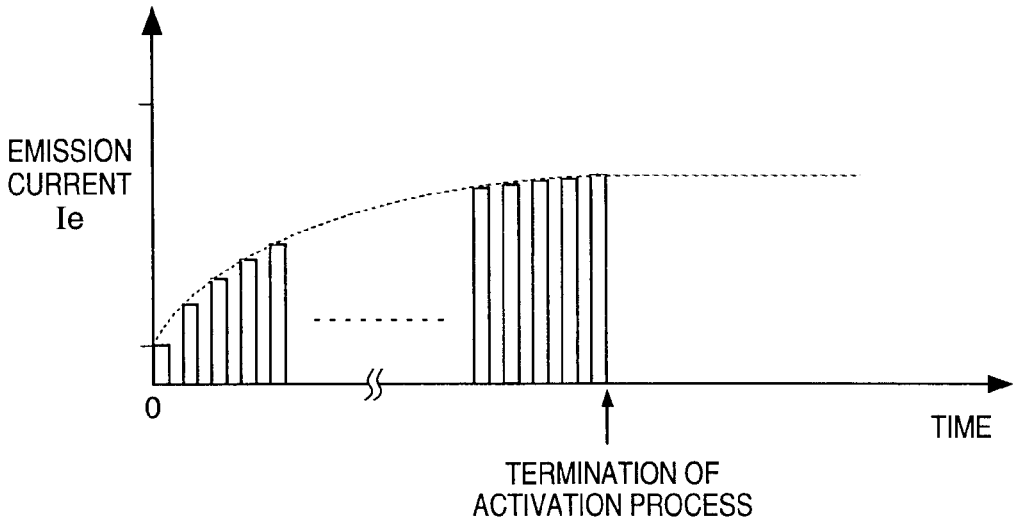

Referring to FIG. 18D, reference numeral 1114 denotes an anode electrode connected to a DC high-voltage power supply 1115 and an ammeter 1116 to capture an emission current Ie emitted from the surface-conduction emission device. Note that when the substrate 1101 is incorporated into the display panel 1 before the activation process, the phosphor surface of the display panel 1 is used as the anode electrode 1114. While applying a voltage from the activation power supply 1112, the ammeter 1116 measures the emission current Ie to monitor the progress of the activation process so as to control the operation of the activation power supply 1112. FIG. 20B shows an example of the emission current Ie measured by the ammeter 1116.

As application of a pulse voltage from the activation power supply 1112 is started, the emission current Ie increases with the elapse of time, gradually reaches saturation, and rarely increases thereafter. At the substantial saturation point of the emission current Ie, the voltage application from the activation power supply 1112 is stopped, and the activation process is then terminated.

Note that the above electrification conditions are preferable to manufacture the surface-conduction emission device of the present invention. When the design of the surface-conduction emission device is changed, the conditions are preferably changed in accordance with the change in device design.

Figure 18E:
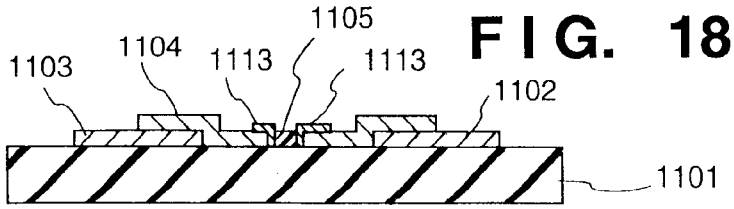

The plane type surface-conduction emission device shown in FIG. 18E is manufactured in the above manner.

(Step Type Surface-conduction Emission Device)

Another typical surface-conduction emission device having an electron-emitting portion or its peripheral portion formed of a fine particle film, i.e., a step type surface-conduction emission device will be described below.

Figure 21:
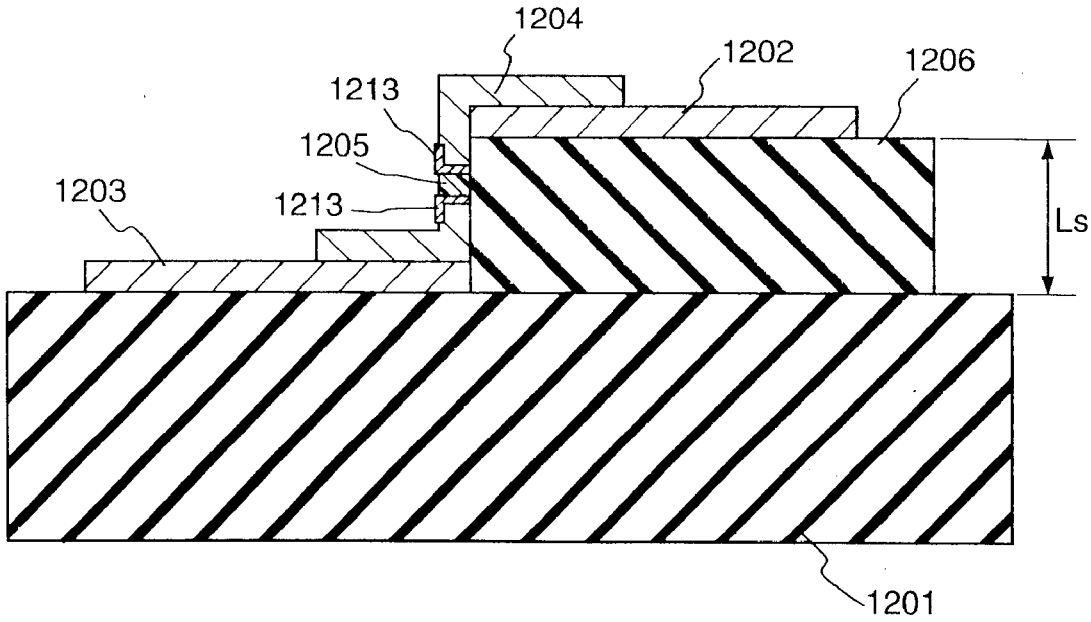
FIG. 21 is a sectional view of a step type surface-conduction emission device used in the present invention.

FIG. 21 is a sectional view for explaining the basic arrangement of the step type surface-conduction emission device.

Referring to FIG. 21, reference numeral 1201 denotes a substrate; 1202 and 1203, device electrodes; 1206, a step forming member; 1204, a conductive thin film using a fine particle film; 1205, an electron-emitting portion formed by a energization forming process; and 1213, a thin film formed by an activation process.

The step type surface-conduction emission device differs from the plane type electron-emitting device described above in that one device electrode (1202) is formed on the step forming member 1206, and the conductive thin film 1204 covers a side surface of the step forming member 1206. Therefore, the device electrode spacing L of the plane type device shown in FIGS. 17A and 17B corresponds to a step height Ls of the step forming member 1206 of the step type device. For the substrate 1201, the device electrodes 1202 and 1203, and the conductive thin film 1204 using a fine particle film, the same materials as enumerated in the description of the plane type surface-conduction emission device can be used. For the step forming member 1206, an electrically insulating material such as $SiO_2$ is used.

A method of manufacturing the step type surface-conduction emission device will be described below. FIGS. 22A to 22F are sectional views for explaining steps in manufacturing the step type surface-conduction emission device. The same reference numerals as in FIG. 21 denote the same members in FIGS. 22A to 22F, and a detailed description thereof will be omitted.

Figure 22A:
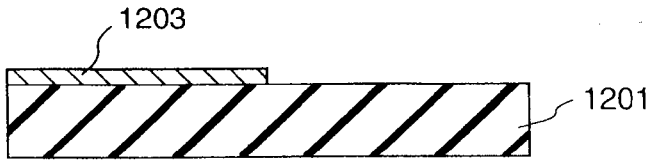
FIGS. 22A to 22F are sectional views showing steps in manufacturing the step type surface-conduction emission device.

(1) As shown in FIG. 22A, the device electrode 1203 is formed on the substrate 1201.

Figure 22B:
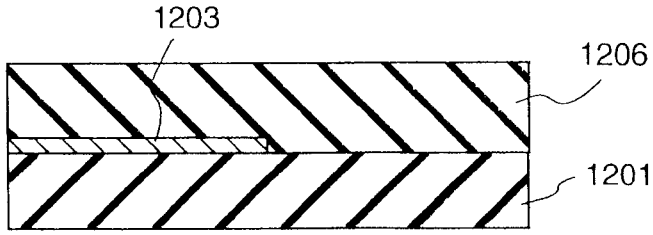

(2) As shown in FIG. 22B, the insulating layer for forming the step forming member is stacked on the resultant structure. For the insulating layer, e.g., an $SiO_2$ layer is formed by sputtering. However, another film-forming method such as vacuum deposition or printing may be used.

Figure 22C:
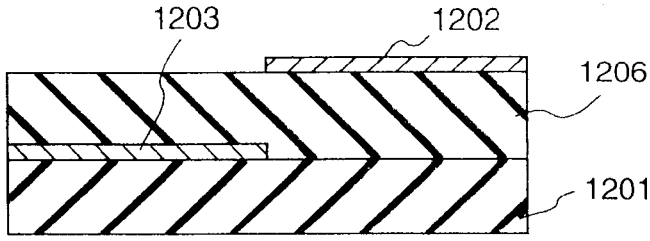

(3) As shown in FIG. 22C, the device electrode 1202 is formed on the insulating layer.

Figure 22D:
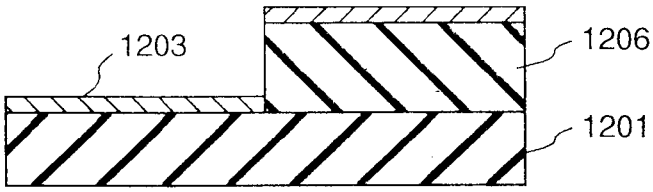

(4) As shown in FIG. 22D, part of the insulating layer is removed by, e.g., etching to expose the device electrode 1203.

Figure 22E:
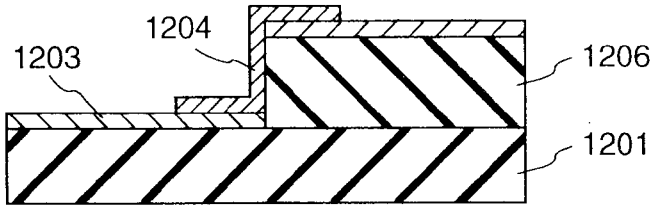

(5) As shown in FIG. 22E, the conductive thin film 1204 using a fine particle film is formed. To form the conductive thin film 1204, a film-forming method such as a coating method can be used, as in the plane type surface-conduction emission device.

(6) As in the plane type surface-conduction emission device, a energization forming process is performed to form an electron-emitting portion (the same energization forming process as that of the plane type surface-conduction emission device, which has been described with reference to FIG. 18C, is performed).

(7) As in the plane type surface-conduction emission device, an activation process is performed to deposit carbon or a carbon compound near the electron-emitting portion (the same activation process as that of the plane type surface-conduction emission device, which has been described with reference to FIG. 18D, is performed).

Figure 22F:
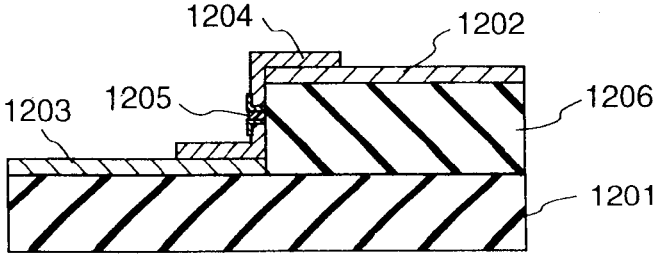

In the above-described manner, the step type surface-conduction emission device shown in FIG. 22F is manufactured.

(Features of Surface-conduction Emission Device Used for Display Apparatus)

The arrangements and manufacturing methods of the plane and step type surface-conduction emission devices have been described above. The characteristics of the device used for the display apparatus will be described below.

Figure 23:
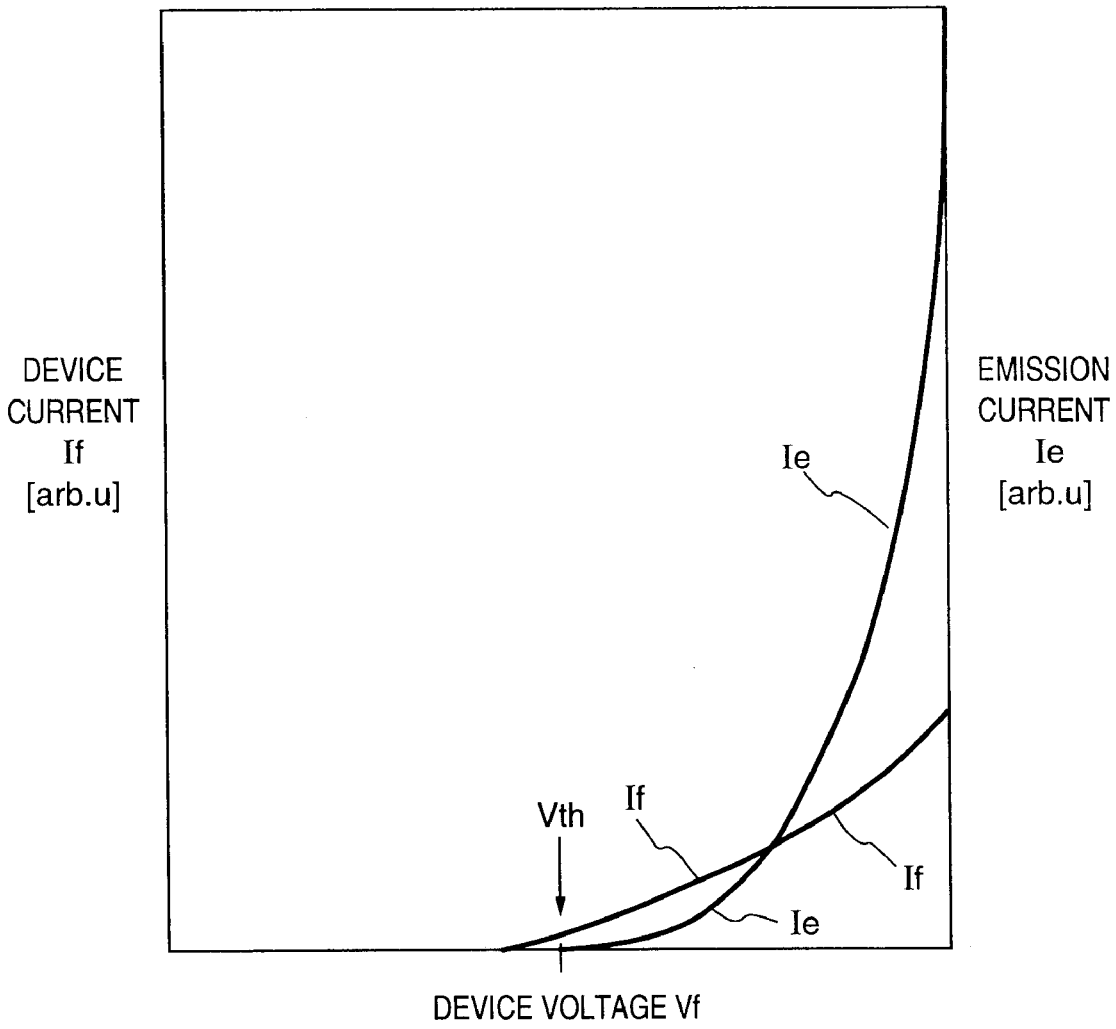
FIG. 23 is a graph showing the typical characteristics of the surface-conduction emission device used in the present invention.

FIG. 23 is a graph showing typical examples of the (emission current Ie) vs. (device applied voltage Vf) characteristic and the (device current If) vs. (device applied voltage Vf) characteristic. The emission current Ie is much smaller than the device current If, and these two characteristics can hardly be illustrated on the basis of the same scale. In addition, these characteristics change upon changing the design parameters including the size and shape of the device. For these reasons, the two characteristics in FIG. 23 are illustrated using arbitrary units, respectively.

The surface-conduction electron-emitting device used for this display apparatus has the following three features with respect to the emission current Ie.

First, when a voltage higher than a certain voltage (to be referred to as a threshold voltage Vth hereinafter) is applied to the device, the emission current Ie abruptly increases. When the applied voltage is lower than the threshold voltage Vth, almost no emission current Ie is detected. That is, the surface-conduction emission device is a nonlinear device having the clearly defined threshold voltage Vth with respect to the emission current Ie.

Second, since the emission current Ie changes depending on the voltage Vf applied to the device, the magnitude of the emission current Ie can be controlled by the voltage Vf.

Third, since the response of the current Ie emitted from the device with respect to the voltage Vf applied to the surface-conduction emission device is high, the charge amount of electrons emitted from the device can be controlled by the length of time over which the voltage Vf is applied.

Because of the above features, the surface-conduction emission device can be suitably applied to the display apparatus. For example, when the first feature is used in the display apparatus in which a lot of devices are arranged in correspondence with the pixels of the display screen, the display screen can be sequentially scanned to perform a display operation. More specifically, in accordance with a desired light emission luminance, a voltage equal to or higher than the threshold voltage Vth is appropriately applied to devices which are being driven. A voltage lower than the threshold voltage Vth is applied to unselected devices. By sequentially switching the devices to be driven, the display screen can be sequentially scanned to perform the display operation.

When the second or third feature is used, the light emission luminance can be controlled. Therefore, gradation display is enabled.

(Structure of Multi-electron-beam Source Having Many Devices Wired in Simple Matrix)

The structure of a multi-electron-beam source in which the above-described surface-conduction emission devices are arranged on a substrate and wired in a simple matrix will be described below.

Figure 24:
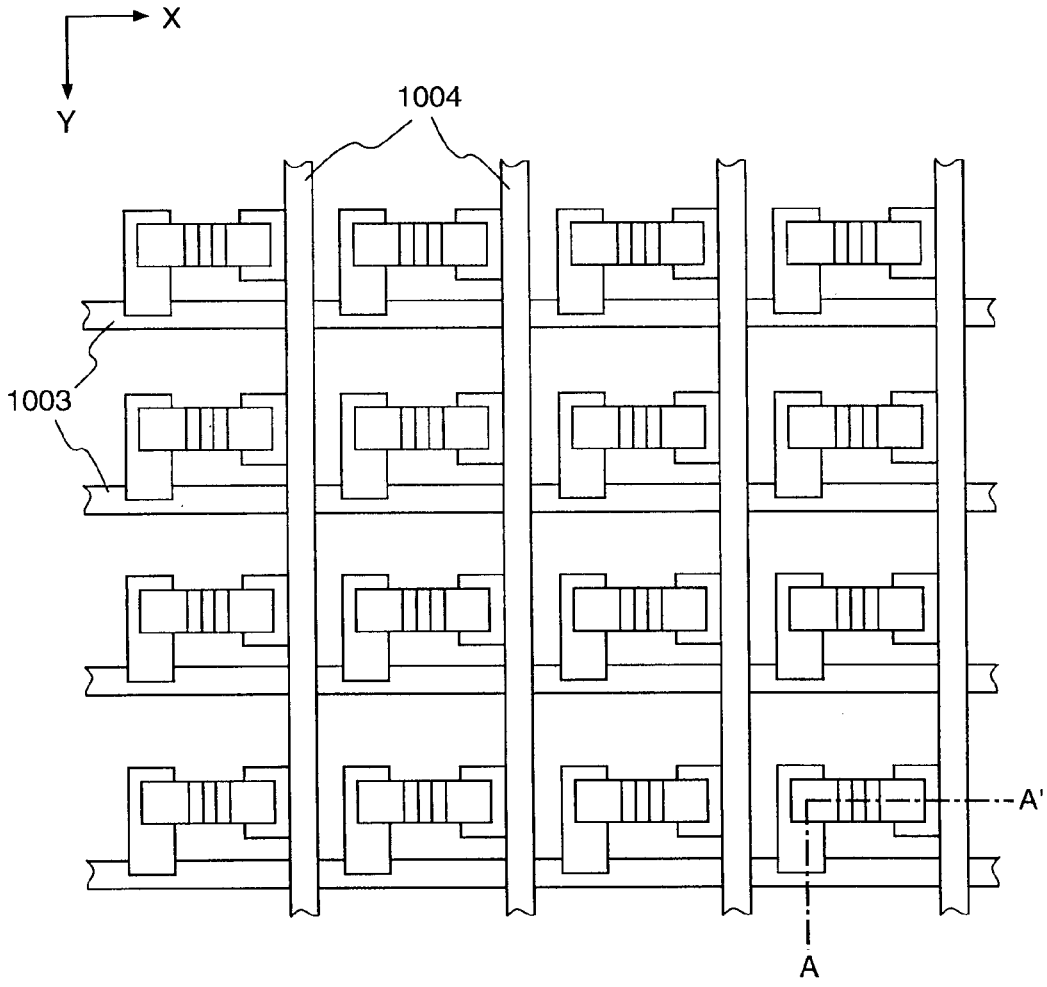
FIG. 24 is a plan view of the substrate of the multi-electron-beam source used in the present invention.

FIG. 24 is a plan view showing the multi-electron-beam source used in the display panel 1 shown in FIG. 15. The surface-conduction emission devices each having the same structure as shown in FIGS. 17A and 17B are arranged on the substrate 1001. These devices are wired in a simple matrix by the row wiring layers 1003 and the column wiring layers 1004. At intersections of the row wiring layers 1003 and the column wiring layers 1004, insulating layers (not shown) are formed between the wiring layers such that electrical insulation is maintained.

Figure 25:
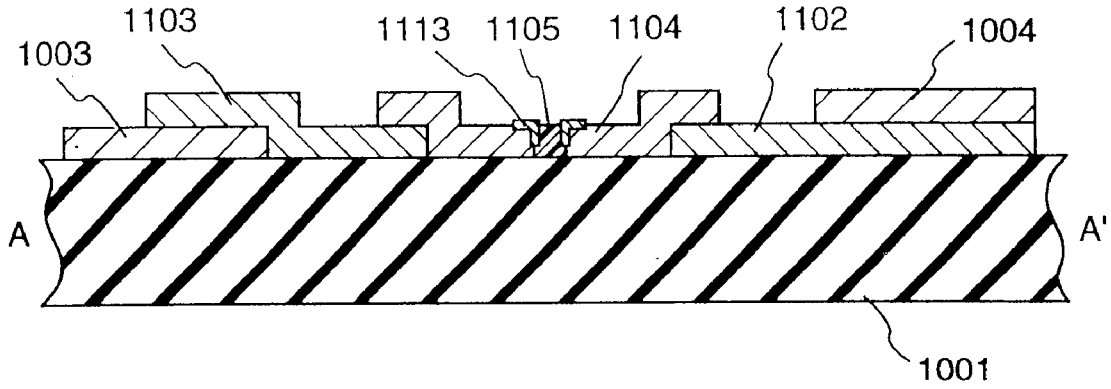
FIG. 25 is a partial sectional view of the substrate of the multi-electron-beam source used in the present invention.

FIG. 25 is a sectional view taken along a line A–A' in FIG. 24.

The multi-electron-beam source having the above structure is manufactured in the following manner. The row wiring layers 1003, the column wiring layers 1004, the interelectrode insulating layers (not shown), and the device electrodes and conductive thin films of the surface-conduction emission devices are formed on the substrate in advance. Thereafter, a power is supplied to the respective devices through the row wiring layers 1003 and the column wiring layers 1004 to perform the energization forming process and the activation process, thereby manufacturing the multi-electron-beam source, as described above.

APPLICATION EXAMPLE

Figure 26:
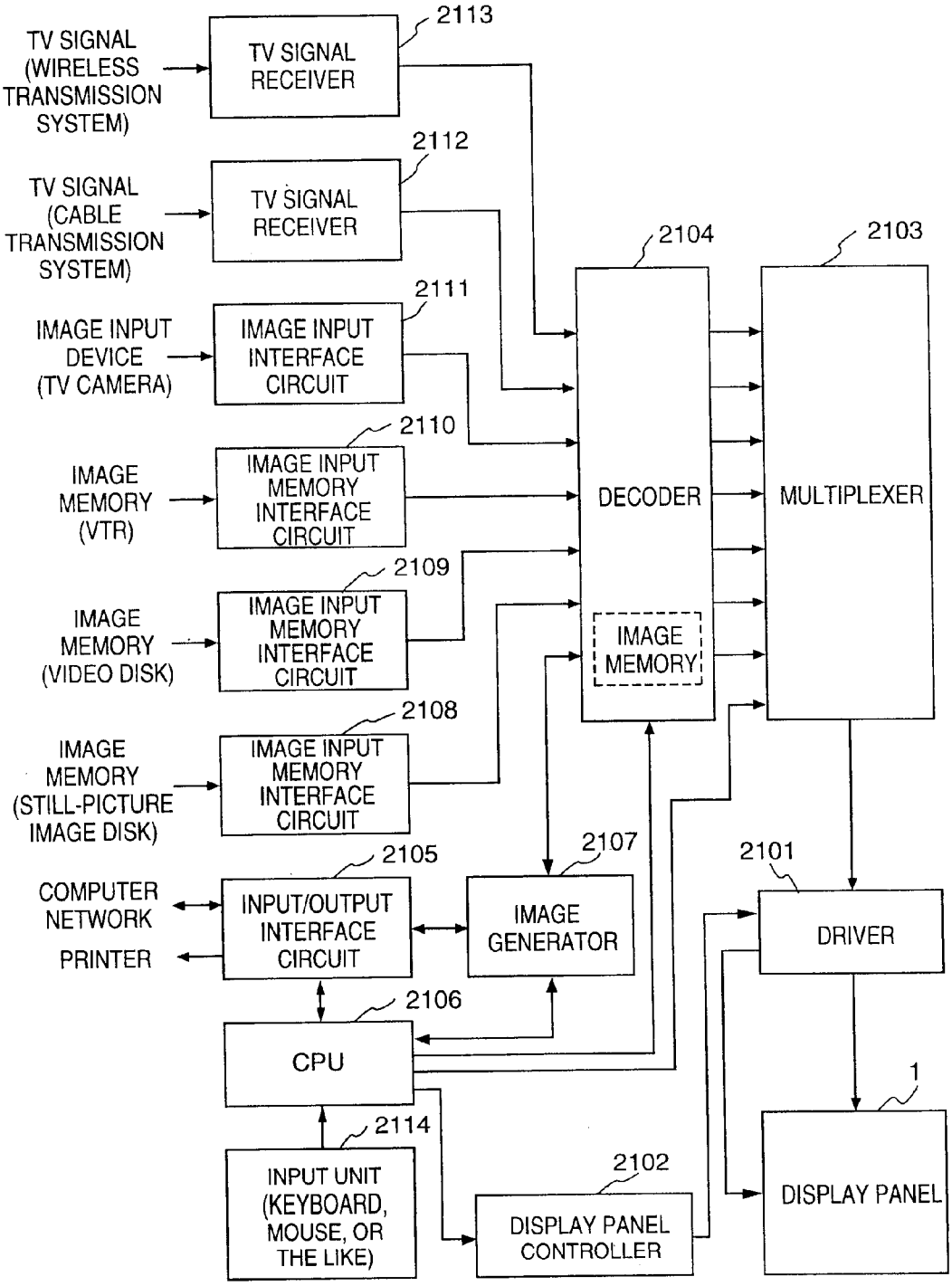
FIG. 26 is a block diagram showing the arrangement of a multifunction image display apparatus according to the present invention.
Figure 27:
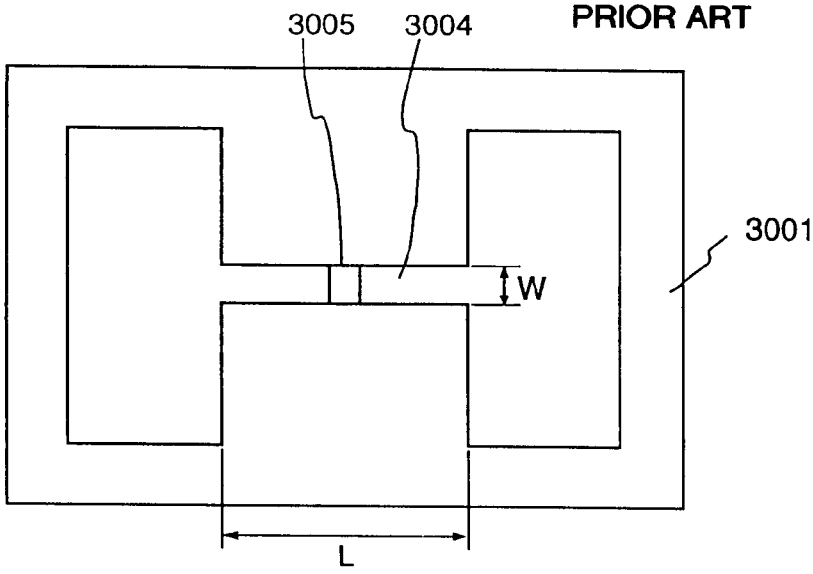
FIG. 27 PRIOR ART
FIG. 27 is a plan view showing the structure of a conventional surface-conduction emission device.
Figure 28:
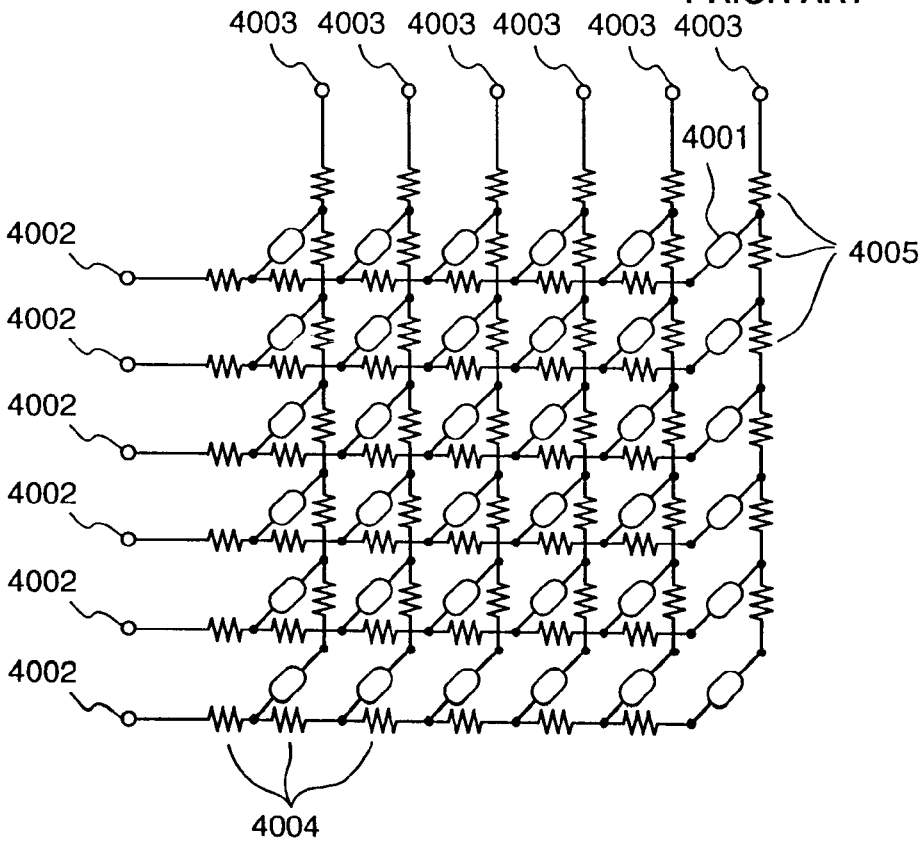
FIG. 28 PRIOR ART
FIG. 28 is a view for explaining the matrix wiring of a conventional multi-electron-beam source.

FIG. 26 is a block diagram showing an example of a multifunction display apparatus capable of displaying image information supplied from various image information sources such as TV broadcasting on a display panel using the surface-conduction emission devices of the present invention as electron-emitting devices.

Referring to FIG. 26, reference numeral 1 denotes a display panel of the present invention; 2101, a driver of the display panel 1; 2102, a display panel controller; 2103, a multiplexer; 2104, a decoder; 2105, an input/output interface circuit; 2106, a CPU; 2107, an image generator; 2108 to 2110; image memory interface circuits, 2111, an image input interface circuit; 2112 and 2113, TV signal receivers; and 2114, an input unit. When the display apparatus of this example receives a signal such as a TV signal including both video information and audio information, video images and sound are reproduced simultaneously, as a matter of course. A description of circuits and speakers which are associated with reception, separation, processing, and storage of audio information will be omitted because these components are not directly related to the features of the display panel of this example. The functions of the respective components will be described below in accordance with the flow of an image signal.

The TV signal receiver 2113 is a circuit for receiving TV image signals transmitted via a wireless transmission system such as electric wave transmission or space optical communication. The standards of the TV signals to be received are not particularly limited, and any one of the NTSC, PAL, and SECAM standards may be used. In addition, a TV signal comprising a larger number of scanning lines (e.g., a signal for a so-called high-definition TV represented by the MUSE standard) is a preferable signal source for utilizing the advantageous features of the display panel applicable to a large display screen and numerous pixels. The TV signal received by the TV signal receiver 2113 is output to the decoder 2104. The TV signal receiver 2112 is a circuit for receiving TV image signals transmitted via a cable transmission system such as a coaxial cable system or an optical fiber system. Like the TV signal receiver 2113, the standards of the TV signals to be received are not particularly limited. The TV signal received by the TV signal receiver 2112 is also output to the decoder 2104.

The image input interface circuit 2111 is a circuit for receiving an image signal supplied from an image input device such as a TV camera or an image reading scanner. The received image signal is output to the decoder 2104. The image memory interface circuit 2110 is a circuit for receiving an image signal stored in a video tape recorder (to be abbreviated as a VTR hereinafter). The received image signal is output to the decoder 2104. The image memory interface circuit 2109 is a circuit for receiving an image signal stored in a video disk. The received image signal is output to the decoder 2104. The image memory interface circuit 2108 is a circuit for receiving an image signal from a device such as a still-picture image disk which stores still-picture image data. The received still-picture image data is output to the decoder 2104. The input/output interface circuit 2105 is a circuit for connecting this display apparatus to an external computer, a computer network, or an output device such as a printer. The input/output interface circuit 2105 not only inputs/outputs image data or character data/graphic information but also can input/output control signals or numerical data between the CPU 2106 of the image forming apparatus and an external device, as needed.

The image generator 2107 is a circuit for generating display image data on the basis of image data or character/graphic information externally input through the input/output interface circuit 2105 or image data or character/graphic information output from the CPU 2106. This circuit incorporates circuits necessary for generating image data, including a reloadable memory for accumulating image data or character/graphic information, a read only memory which stores image patterns corresponding to character codes, and a processor for performing image processing. The display image data generated by this circuit is output to the decoder 2104. However, the display image data can be output to an external computer network or a printer through the input/output interface circuit 2105, as needed.

The CPU 2106 mainly performs an operation associated with operation control of the display apparatus, and generation, selection, and editing of a display image. For example, a control signal is output to the multiplexer 2103, thereby appropriately selecting or combining image signals to be displayed on the display panel. At this time, a control signal is generated to the display controller 2102 in accordance with the image signal to be displayed, thereby appropriately controlling the operation of the display panel, including the frame display frequency, the scanning method (e.g., interlaced scanning or non-interlaced scanning), and the number of scanning lines in one frame. In addition, the CPU 2106 directly outputs image data or character/graphic information to the image generator 2107, or accesses an external computer or memory through the input/output interface circuit 2105 to input image data or character/graphic information. The CPU 2106 may operate for other purposes. For example, the CPU 2106 may be directly associated with a function of generating or processing information, like a personal computer or a wordprocessor. Alternatively, as described above, the CPU 2106 may be connected to an external computer network through the input/output interface circuit 2105 to cooperate with the external device in, e.g., numerical calculation.

The input unit 2114 is used by the user to input instructions, program, or data to the CPU 2106. In addition to a keyboard and a mouse, various input devices such as a joy stick, a bar-code reader, or a speech recognition device can be used. The decoder 2104 is a circuit for reversely converting various image signals input from the circuits 2107 to 2113 into three primary color signals, or a luminance signal and I and Q signals. As indicated by a dotted line in FIG. 24, the decoder 2104 preferably incorporates an image memory such that TV signals such as MUSE signals which require an image memory for reverse conversion can be processed. An image memory facilitates display of a still-picture image. In addition, the image memory enables facilitation of image processing including thinning, interpolation, enlargement, reduction, and synthesizing, and editing of image data in cooperation with the image generators 2107 and 2106.

The multiplexer 2103 appropriately selects a display image on the basis of a control signal input from the CPU 2106. More specifically, the multiplexer 2103 selects a desired image signal from the reverse-converted image signals input from the decoder 2104 and outputs the selected image signal to the driver 2101. In this case, the multiplexer 2103 can realize so-called multiwindow television, where the screen is divided into a plurality of areas to display a plurality of images in the respective areas, by selectively switching image signals within a display period for one frame. The display controller 2102 is a circuit for controlling the operation of the driver 2101 on the basis of a control signal input from the CPU 2106.

For the basic operation of the display panel, the display controller 2102 outputs a signal for controlling the operation sequence of the driving power supply (not shown) of the display panel to the driver 2101. For the method of driving the display panel, the display controller 2102 outputs a signal for controlling the frame display frequency or the scanning method (e.g., interlaced scanning or non-interlaced scanning) to the driver 2101. The display panel controller 2102 outputs a control signal associated with adjustment of the image quality including the luminance, contrast, color tone, and sharpness of a display image to the driver 2101, as needed. The driver 2101 is a circuit for generating a driving signal to be supplied to the display panel 1. The driver 2101 operates on the basis of an image signal input from the multiplexer 2103 and a control signal input from the display panel controller 2102.

The functions of the respective components have been described above. In this example, the display apparatus having the arrangement shown in FIG. 26 can display, on the display panel 1, image information input from various image information sources. More specifically, various image signals including TV broadcasting signals are subjected to reverse conversion by the decoder 2104, appropriately selected by the multiplexer 2103, and input to the driver 2101. The display panel controller 2102 generates a control signal for controlling the operation of the driver 2101 in accordance with the image signal to be displayed. The driver 2101 supplies a driving signal to the display panel 1 on the basis of the image signal and the control signal. With this operation, an image is displayed on the display panel 1. The series of operations are integrally controlled by the CPU 2106.

The display apparatus of this example not only displays image data selected from a plurality of image information in association with the image memory incorporated in the decoder 2104, the image generator 2107, and the CPU 2106, but also can perform, for image information to be displayed, image processing including enlargement, reduction, rotation, movement, edge emphasis, thinning, interpolation, color conversion, and aspect ratio conversion, and image editing including synthesizing, deletion, combining, replacement, and insertion. Though not particularly referred to in the description of this example, circuits dedicated to processing and editing of audio information may be arranged, as for image processing and image editing.

The display apparatus of this example can realize function of various devices, e.g., a TV broadcasting display device, a teleconference terminal device, an image editing device for still-pictures and moving pictures, an office-work terminal device such as a computer terminal or a wordprocessor, a game machine, and the like. Therefore, the display apparatus has a wide application range for industrial and private use. FIG. 26 only shows an example of the arrangement of the display apparatus using the display panel in which surface-conduction emission devices are used as an electron source, and the display apparatus is not limited to this arrangement, as a matter of course. For example, of the constituent elements shown in FIG. 26, circuits associated with functions unnecessary for the application purpose can be omitted. Reversely, constituent elements can be added in accordance with the application purpose. When this display apparatus is to be used as a visual telephone, preferably, a TV camera, a microphone, an illumination device, a transmission/reception circuit including a modem may be added.

Since this display apparatus uses, as its electron source, surface-conduction emission devices, a low-profile display panel can be realized, so that the depth of the display apparatus can be reduced. In addition, since the display panel using surface-conduction emission devices as the electron source can be easily enlarged, and it has a high luminance and a wide view angle, the image forming apparatus can display vivid images with realism and impressiveness.

The present invention can be applied to a system constituted by a plurality of devices such as a host computer, an interface, and a printer, or to an apparatus comprising a single device. Furthermore, the present invention is applicable also to a case where the invention is realized by supplying a program to a system or apparatus. In this case, a memory medium storing the program according to the present invention constitutes the invention. The system or apparatus is operated in a manner defined in advance by reading out the program from the memory medium to the system or apparatus.

As has been described above, according to the present invention, a multi-electron-beam source which eliminates variations in emission characteristics of the surface-conduction emission devices, which are generated in the process of manufacturing the electron source, and has uniform electron-emitting characteristics can be provided.

When the electron source having such characteristics is used, an image forming apparatus capable of obtaining a high-quality image with a uniform luminance distribution can be provided.

In addition, when the memory voltage (shift voltage) is set to fall outside the normal voltage range for driving the surface-conduction emission device, the characteristics of the surface-conduction emission device are prevented from changing during a normal operation.

Furthermore, since the electron-emitting characteristics of each surface-conduction emission device of the multi-electron-beam source can be measured using any one of the emission current, the device current, and the light emission luminance, various methods can be employed to measure and adjust the characteristics.

As many apparently widely different embodiments of the present invention can be made without departing from the spirit and scope thereof, it is to be understood that the invention is not limited to the specific embodiments thereof except as defined in the appended claims.

What is claimed is:

1. A method of adjusting characteristics of an electron generating apparatus having a multi-electron-beam source in which a plurality of surface-conduction emission devices are arranged on a substrate, each of the plurality of surface-conduction emission devices emits electrons by applying a driving voltage, comprising the steps of:

applying a characteristic measuring voltage to measure the characteristics of said plurality of surface-conduction emission devices;

obtaining a reference value of the characteristics of said plurality of surface-conduction emission devices on the basis of the measured electron-emitting characteristics; and applying a characteristic shift voltage to a corresponding one of said plurality of surface-conduction emission devices such that the electron-emitting characteristics of said plurality of surface-conduction emission devices become values according to the reference value, wherein the characteristic shift voltage is higher than the characteristic measuring voltage, and the characteristic measuring voltage is higher than the driving voltage.

2. The method according to claim 1, wherein the characteristic shift voltage is applied in an atmosphere in which a partial pressure of an organic gas is not more than $10^{-8}$ Torr.

3. The method according to claim 1, further comprising the steps of:

measuring the characteristics of said plurality of surface-conduction emission devices again after application of the characteristic shift voltage, and applying the characteristic shift voltage to said corresponding surface-conduction emission device again on the basis of a remeasurement result.

4. The method according to claim 1, wherein the measuring step comprises measuring an emission current emitted from said surface-conduction emission device every time said surface-conduction emission device is driven.

5. The method according to claim 1, wherein the measuring step comprises measuring a device current flowing in said surface-conduction emission device every time said surface-conduction emission device is driven.

6. The method according to claim 1, wherein the measuring step comprises measuring a light emission luminance of the phosphor irradiated by the electron from said surface-conduction emission device every time said surface-conduction emission device is driven, and converting the measured luminance into a value corresponding to one of the emission current and the device current.

7. The method according to claim 1, wherein the characteristic measuring voltage is applied to each of said plurality of surface conduction emission devices.

8. A method of manufacturing an electron generating apparatus having a multi-electron-beam source in which a plurality of surface-conduction emission devices are arranged in a matrix on a substrate, each of the plurality of surface-conduction emission devices emits electrons by applying a driving voltage, comprising the steps of:

forming electrodes and conductive films for said plurality of surface-conduction emission devices on said substrate;

forming electron-emitting portions for said plurality of surface-conduction emission devices by performing electrification to said conductive films through said electrodes;

activating said electron-emitting portions;

applying a characteristic measuring voltage to measure characteristics of said plurality of surface-conduction emission devices;

obtaining a reference value of the characteristics of said plurality of surface-conduction emission devices on the basis of the measured electron-emitting characteristics; and applying a characteristic shift voltage to a corresponding one of said plurality of surface-conduction emission devices such that the electron-emitting characteristics of said plurality of surface-conduction emission devices become values according to the reference value, wherein the characteristic shift voltage is higher than the characteristic measuring voltage, and the characteristic measuring voltage is higher than the driving voltage.

9. The method according to claim 8, wherein the characteristic shift voltage is applied in an atmosphere in which a partial pressure of an organic gas is not more than $10^{-8}$ Torr.

10. The method according to claim 8, further comprising the steps of:

measuring the characteristics of said plurality of surface-conduction emission devices again after application of the characteristic shift voltage, and applying the characteristic shift voltage to said corresponding surface-conduction emission device again on the basis of a remeasurement result.

11. The method according to claim 8, wherein the measuring step comprises measuring an emission current emitted from said surface-conduction emission device every time said surface-conduction emission device is driven.

12. The method according to claim 8, wherein the measuring step comprises measuring a device current flowing in said surface-conduction emission device every time said surface-conduction emission device is driven.

13. The method according to claim 8, wherein the measuring step comprises measuring a light emission luminance of the phosphor irradiated by the electron from said surface-conduction emission device every time said surface-conduction emission device is driven, and converting the measured luminance into a value corresponding to one of the emission current and the device current.

14. An electron generating apparatus having a multi-electron-beam source, said apparatus having been made according to the method of claim 7.

15. An image forming apparatus comprising:

an electron generating apparatus made according to the method of claim 7, and a phosphor that emits light upon irradiation by an electron beam emitted from said electron generating apparatus.

16. The method according to claim 8, wherein the characteristic measuring voltage is applied to each of said plurality of surface-conduction emission devices.

17. A method of adjusting an electron generating apparatus having a multi-electron-beam source that includes a plurality of electron emission devices arranged on a substrate, each of the electron emission devices emits electrons by applying a driving voltage between electrodes of the electron emitting device, the method comprising:

a first step of applying a voltage greater than the driving voltage between electrodes of each of the plurality of electron emission devices; and a second step of applying another voltage greater than the voltage applied in said first step, between the electrodes of at least one selected electron emission device, such that an electron emission characteristic of the electron emission device is changed with respect to a voltage applied between the electrodes of the electron emission device.

18. The method according to claim 17, wherein predetermined characteristics of the plurality of electron emission devices become uniform in said second step.

19. The method according to claim 17, wherein said first and second steps are implemented in an atmosphere in which a partial pressure of an organic gas is not more than $10^{-8}$ Torr.

20. The method according to claim 17, wherein electron-emitting portions are formed on at least some of the electron emission devices, and the first step is performed to apply the voltage to those electron emission devices.

21. The method according to claim 17, wherein each electron emission device is a surface-conduction electron emission device.

22. The method according to claim 17, wherein the at least one selected electron emission device is an electron emission device requiring further voltage application.

23. A method of manufacturing an electron generating apparatus having a multi-electron-beam source that includes a plurality of electron emission devices arranged on a substrate, each of the electron emission devices emits electrons by applying a driving voltage between electrodes of the electron emission device, the method comprising:

a first step of applying a voltage greater than the driving voltage between electrodes of each of the plurality of electron emission devices; and a second step of applying a voltage greater than the voltage applied in said first step, between the electrodes of at least one selected electron emission device, such that an electron emission characteristic of the electron emission device is changed with respect to a voltage applied between the electrodes of the electron emission device.

24. The method according to claim 23, wherein predetermined characteristics of the plurality of electron emission devices become uniform in said second step.

25. The method according to claim 23, wherein said first and second step are implemented in an atmosphere in which a partial pressure of an organic gas is not more than $10^{-8}$ Torr.

26. The method according to claim 23, wherein said first step is performed to apply the first voltage to at least some of the plurality of electron emission devices in which electron-emitting portions are formed.

27. The method according to claim 23, wherein each electron emission device is a surface-conduction electron emission device.

28. The method according to claim 23, wherein the at least one selected electron emission device is an electron emission device requiring further voltage application.

29. A method of manufacturing an electron generating apparatus having a multi-electron-beam source that includes a substrate and a plurality of electron emission devices arranged on the substrate, the method comprising the steps of:

a step of forming an electron-emitting portion in each of the plurality of electron emission devices;

a first voltage applying step of applying a first voltage greater than a driving voltage of an electron emission device, to each of the plurality of electron emission devices;

a second voltage applying step of applying a second voltage greater than the first voltage applied in said first voltage applying step, to at least one selected electron emission device; and a step of activating the electron-emitting portion of each of the plurality of electron emission devices prior to said first step.

30. The method according to claim 29, wherein the at least one selected electron emission device is an electron emission device requiring further voltage application.

31. A method of manufacturing an electron generating apparatus having a multi-electron-beam source that includes a substrate and a plurality of electron emission devices arranged on the substrate, the method comprising the steps of:

a step of forming an electron-emitting portion in each of the plurality of electron emission devices;

a first voltage applying step of applying a first voltage greater than a driving voltage of an electron emission device, to each of the plurality of electron emission devices;

a second voltage applying step of applying a second voltage greater than the first voltage applied in said first voltage applying step, to at least one selected electron emission device; and a step of depositing a carbon or a carbon compound around an electron emitting portion of at least one of said electron emission devices prior to said first step.

32. The method according to claim 31, wherein the at least one selected electron emission device is an electron emission device requiring further voltage application.

* * * * *

UNITED STATES PATENT AND TRADEMARK OFFICE

CERTIFICATE OF CORRECTION

PATENT NO. : 6,621,475 B1
DATED : September 16, 2003
INVENTOR(S) : Eiji Yamaguchi et al.

It is certified that error appears in the above-identified patent and that said Letters Patent is hereby corrected as shown below:

Column 1,
Line 33, "Advance" should read -- Advances --.

Column 5,
Line 43, "higher" should read -- higher than --.

Column 11,
Line 17, "is" should read -- are --;
Line 25, "does" should read -- do --; and
Line 27, "has" should read -- have --.

Column 12,
Line 36, "is" should read -- are --.

Column 15,
Line 19, "is" should read -- are --;
Line 20, "actually" should read -- actual --;
Lines 22 and 48, "has" should read -- have --;
Line 38, "is" should read -- are --;
Line 46, "does" should read -- do --; and
Line 55, "an" should be deleted.

Column 17,
Line 13, "is" should read -- are --;
Line 21, "does" should read -- do --; and
Line 66, "all the" should be deleted.

UNITED STATES PATENT AND TRADEMARK OFFICE

CERTIFICATE OF CORRECTION

PATENT NO. : 6,621,475 B1
DATED : September 16, 2003
INVENTOR(S) : Eiji Yamaguchi et al.

It is certified that error appears in the above-identified patent and that said Letters Patent is hereby corrected as shown below:

Column 32,
Line 3, "claim 7." should read -- claim 8. --; and
Line 5, "claim 7," should read -- claim 8, --.

Signed and Sealed this

Second Day of August, 2005

JON W. DUDAS
*Director of the United States Patent and Trademark Office*